US008758155B1

(12) United States Patent
Demkowski et al.

(10) Patent No.: US 8,758,155 B1
(45) **Date of Patent: *Jun. 24, 2014**

(54) GOLF CLUB SHAFT

(71) Applicant: Taylor Made Golf Company, Inc., Carlsbad, CA (US)

(72) Inventors: Paul M. Demkowski, San Diego, CA (US); Ryuichi Sugimae, Oceanside, CA (US); Michael Walker, Vista, CA (US); Bret H. Wahl, Escondido, CA (US); Drew T. DeShiell, Oceanside, CA (US); Eric Michael Sentianin, Long Beach, CA (US); Marni D. Ines, San Marcos, CA (US); Chris Schartiger, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/709,426

(22) Filed: Dec. 10, 2012

Related U.S. Application Data

(62) Division of application No. 12/718,312, filed on Mar. 5, 2010, now Pat. No. 8,328,657.

(60) Provisional application No. 61/209,441, filed on Mar. 6, 2009.

(51) Int. Cl.
*A63B 53/16* (2006.01)

(52) U.S. Cl.
USPC ..... 473/296

(58) Field of Classification Search
USPC ..... 473/293–299, 239, 318; 403/109.1–109.8
See application file for complete search history.

(56) References Cited

U.S. PATENT DOCUMENTS

| | | | |
|---|---|---|---|
| 1,569,765 | A | 1/1926 | William |
| 3,539,185 | A | 11/1970 | Andis |
| 4,653,142 | A | 3/1987 | Upton |
| 4,690,407 | A | 9/1987 | Reisner |
| 6,776,724 | B1 | 8/2004 | Siemsglusz |
| 6,875,123 | B2 | 4/2005 | Wilson |
| 7,074,135 | B2 | 7/2006 | Moore |
| 7,252,597 | B2 | 8/2007 | Li et al. |
| 7,422,526 | B2 | 9/2008 | Nemeckay |
| 7,563,173 | B2 | 7/2009 | Chol |
| 2005/0261079 | A1 | 11/2005 | Qualizza |
| 2006/0028039 | A1 | 2/2006 | Ernesti |
| 2006/0183563 | A1 | 8/2006 | Nemeckay |
| 2008/0004128 | A1 | 1/2008 | Chol |

*Primary Examiner* — Stephen L. Blau
(74) *Attorney, Agent, or Firm* — Klarquist Sparkman, LLP

(57) ABSTRACT

An adjustable length golf club including an engaging mechanism, a rotational shaft, a locking mechanism, and a lower shaft. The rotational shaft is connected with the engaging mechanism and is configured to rotate upon movement by the engaging mechanism. The locking mechanism is connected with the rotational shaft and includes a locking insert and a locking collar located on the locking insert. The locking insert being is configured to retain the locking collar during axial movement. The lower shaft has an inner surface that is in frictional contact with the locking collar. The locking insert is threadingly engaged with the locking collar and a first rotational movement in a first rotational direction by the rotational shaft causes the locking insert to move the locking collar creating a frictional locking engagement between the locking collar and the inner surface of the lower shaft.

16 Claims, 18 Drawing Sheets

GOLF CLUB SHAFT

CROSS-REFERENCE TO RELATED APPLICATION

This application is a divisional of U.S. patent application Ser. No. 12/718,312, filed on Mar. 5, 2010, which claims the benefit of U.S. Provisional Application No. 61/209,441, filed on Mar. 6, 2009 both of which are incorporated herein by reference.

FIELD

The present disclosure relates to a golf club head. More specifically, the present disclosure relates to an adjustable golf club shaft.

BACKGROUND

Golf is a game in which a player, using many types of clubs, hits a ball into each hole on a golf course in the lowest possible number of strokes. A putter is typically used on a putting green to lightly stroke the ball into the hole.

Typical putter shafts are a fixed length and cannot be adjusted. A grip on a typical putter shaft is stationary with respect to the putter head and a user would need to cut the shaft to make it shorter or purchase another shaft to increase the length.

SUMMARY OF THE DESCRIPTION

In one embodiment, the present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures.

According to one aspect of the present invention, an adjustable length golf club is provided having an engaging mechanism, a key shaft or rotational shaft, a locking mechanism, and a lower shaft. The key shaft is connected with the engaging mechanism and is configured to rotate upon movement by the engaging mechanism.

In one example of the present invention, the locking mechanism is connected with the key shaft and includes a locking insert and a locking collar. The locking insert is located on the locking collar. The locking insert is configured to retain the locking collar during axial movement.

In another example of the present invention, a lower shaft is described having an inner surface that is in frictional contact with the locking collar. The locking insert is threadingly engaged with the locking collar so that a first rotational movement in a first rotational direction by the key shaft causes the locking insert to move the locking collar. The movement of the locking collar creates a frictional locking engagement between the locking collar and the inner surface of the lower shaft.

In yet another example of the present invention, the locking insert is configured to move in a second axial direction away from a club head attached to a lower portion of the lower shaft thereby moving the locking collar from a from a first locked position to an unlocked second position.

According to another aspect of the present invention, an adjustable length golf club is described having an engaging mechanism, a rotational shaft connected with the engaging mechanism and is configured to rotate upon movement by the engaging mechanism, and a locking mechanism connected with the rotational shaft. The locking mechanism includes a locking cam and a cam sleeve located on the locking cam. The locking cam is configured to retain the cam sleeve during axial movement.

A lower shaft connected with the rotational shaft and an upper shaft is configured to receive the lower shaft. A rotational movement by the rotational shaft causes the locking cam to engage the cam sleeve creating a frictional locking engagement between the cam sleeve and the upper shaft.

According to another aspect of the present invention, an adjustable length golf club is described having a grip portion including a grip cover and grip shaft, a lower shaft connected with the grip portion, and a club head connected with a lower portion of the lower shaft.

A first axial direction is co-axial with the lower shaft and extending toward the club head. A second axial direction is opposite the first axial direction. An engaging mechanism is located within the grip portion and connected with a top collar.

A rotational shaft is described that is connected with the engaging mechanism and is configured to rotate upon movement by the engaging mechanism.

A locking mechanism is connected with the rotational shaft and the locking mechanism includes a locking insert and a locking collar located on the locking insert. The locking insert is configured to retain the locking collar during axial movement.

Furthermore, a lower shaft having an inner surface that is in frictional contact with the locking collar is described. The locking insert is movably engaged with the locking collar and a rotational movement by the rotational shaft in a first rotational direction causes the locking collar to move in the second axial direction to create a frictional locking engagement between the locking collar and the inner surface of the lower shaft.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 1:
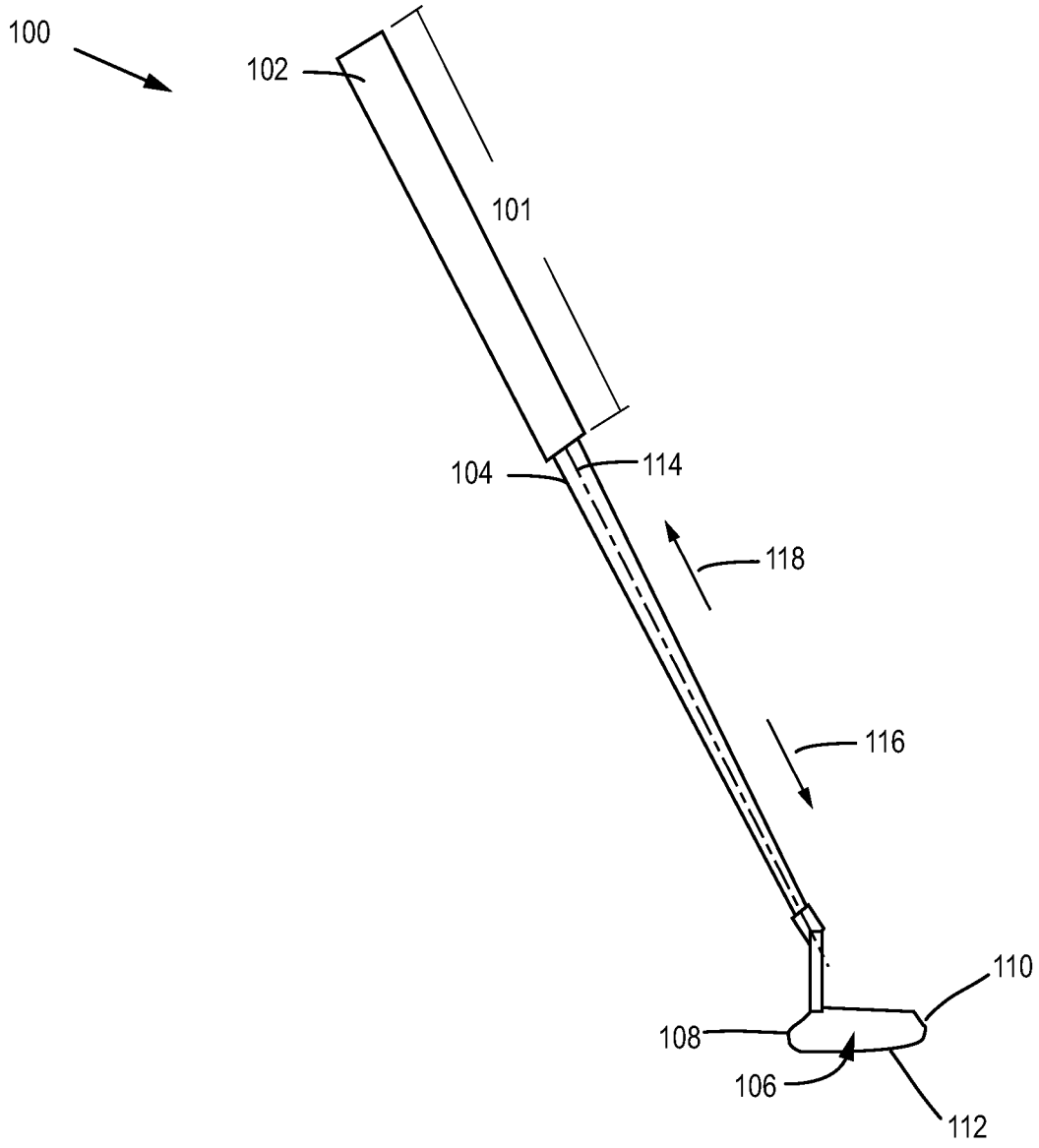
FIG. 1 is an illustration of an embodiment of a golf club according to the present disclosure.

FIG. 1 illustrates a golf club 100 comprising a grip portion 102, a lower shaft 104, and a club head 106. In the embodiment shown in FIG. 1, the golf club 100 is a putter, although the adjustable shaft described herein can be applied to any type of golf club. The club head 106 includes a heel 108, a toe 110, and a sole 112. The lower shaft 104 includes a shaft axis 114 that extends along the length and axial centerline of the golf club 100 shaft. A first axial direction 116 is shown to be extending in a direction toward the club head 106 and parallel with the shaft axis 114.

In addition, FIG. 1 further shows a second axial direction 118 extending in a direction away from the club head 106 and opposite to the direction of the first axial direction 116. The second axial direction 118 is also parallel with the shaft axis 114.

A weight zone 101 is shown and defined as a region of the adjustable shaft that is lightweight and weighs between about 100 g and about 135 g. In one embodiment, the material located within the lightweight zone (extending from the end of the shaft to the end of a the grip portion 102—including the grip portion 102) is between about 100 g and 120 g.

Figure 2A:
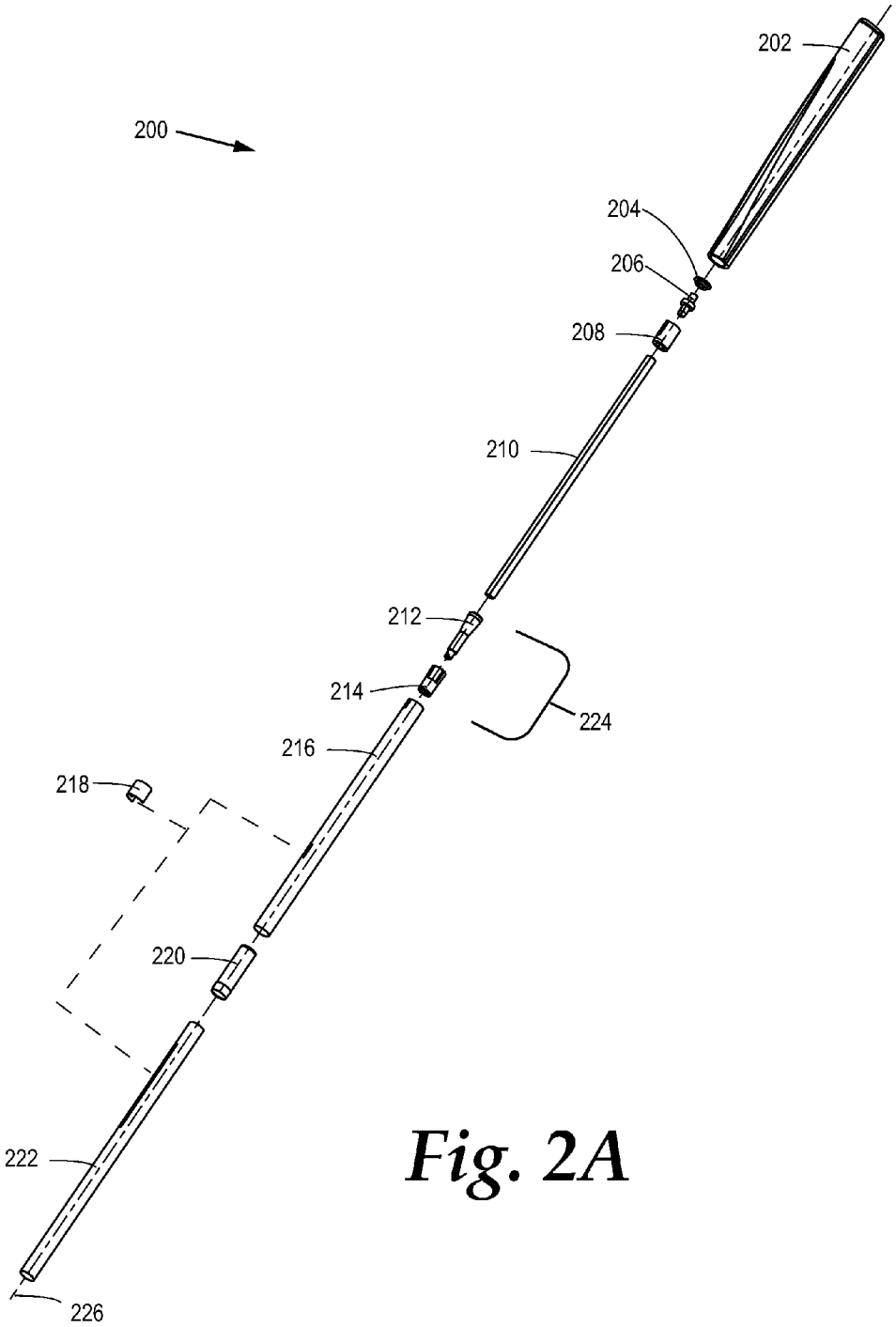
FIG. 2A is an exploded assembly view of an adjustable shaft according to a first embodiment.

FIG. 2A illustrates an exploded assembly view of an exemplary adjustable golf club shaft 200, according to one embodiment. The adjustable golf club shaft 200 includes a grip cover 202, a cap 204, an engaging mechanism 206, a top collar 208, a tubular key shaft 210, a locking insert 212, a locking collar 214, an upper shaft 216, a stop clip 218, a spacer 220, a lower shaft 222, and a centerline axis 226. The locking insert 212 and locking collar 214 comprise a locking mechanism 224. In addition, the grip cover 202 and upper shaft 216 comprise a grip portion.

Figure 2B:
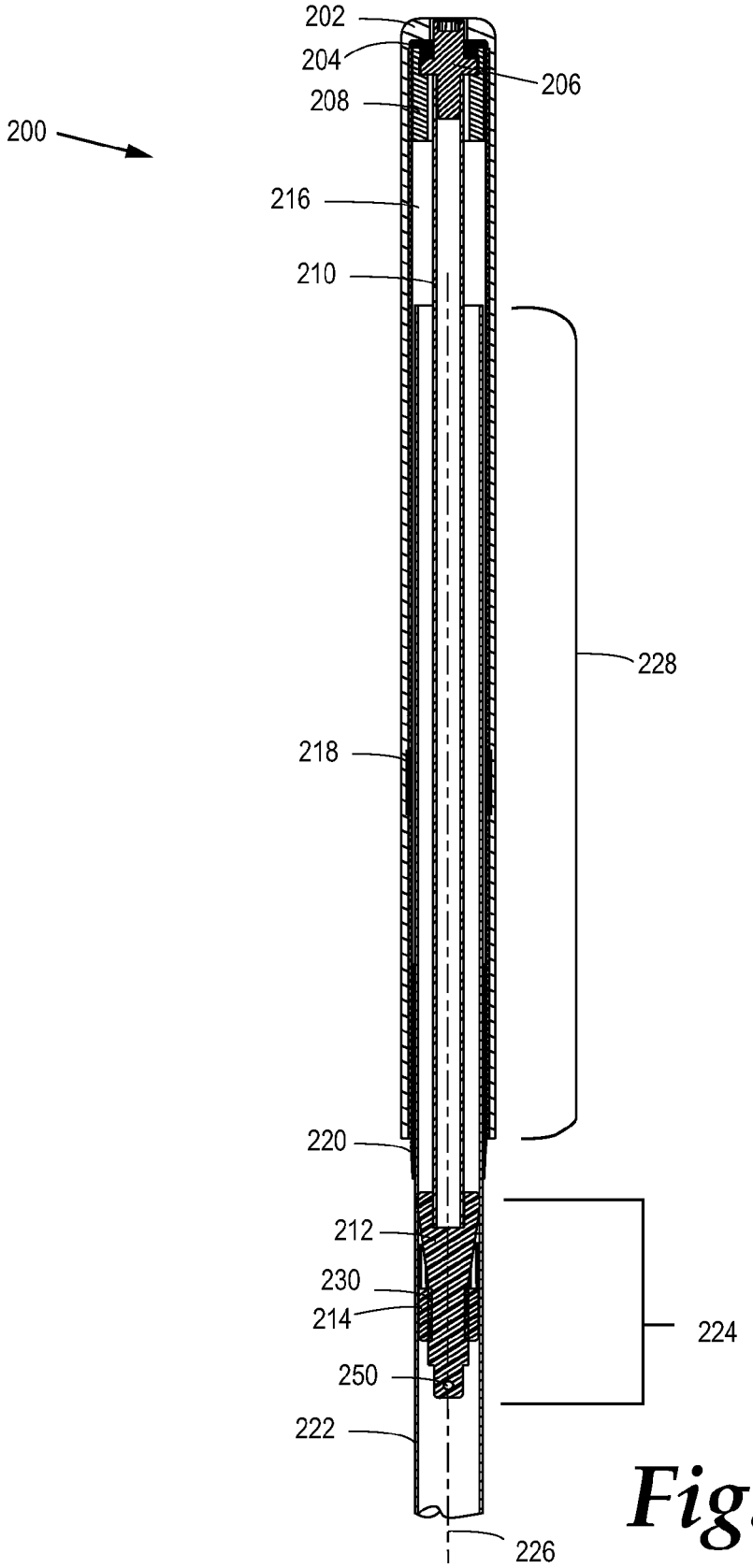
FIG. 2B is a cross-sectional assembled view of the adjustable shaft of FIG. 2A.

FIG. 2B shows an assembled cross-sectional view of the adjustable golf club shaft 200 shown in FIG. 2A. The grip cover 202 envelops an external surface of the upper shaft 216. The upper shaft 216 is coaxially aligned with the lower shaft 222 about the centerline axis 226. The upper shaft 216 and the lower shaft 222 have an overlapping region 228 where the upper shaft 216 telescopically receives the lower shaft 222. The lower shaft 222 is slidably engaged with the upper shaft 216 so that the length of the lower shaft 222 is adjustable with respect to the upper shaft 216. However, the stop clip 218 engages both the upper shaft 216 and lower shaft 222 to prevent the lower shaft 222 from completely disengaging from the upper shaft 216 and to prevent rotation of the upper shaft about the lower shaft, as will be shown in further detail below.

In one preferred embodiment, the upper shaft 216 is a graphite or carbon composite material while the lower shaft 222 is a stainless steel material. The lightweight construction of the upper shaft 216 composite material allows the net weight of the upper portion to be nearly equivalent to that of a standard steel shaft with grip (the majority of the adjustable shaft 200 weight to be distributed in a lower region below the grip portion).

At the top of the upper shaft 216 in a portion of the adjustable golf club shaft 200 that is farthest away from the club head, an engaging mechanism 206 assembly is shown. The engaging mechanism 206 is retained at a first end of the upper shaft 216 by the top collar 208 and cap 204. Specifically, the engaging mechanism 206 is axially restrained by the top collar 208 and cap 204 while still being capable of rotating freely upon a user inserting an engaging tool with the engaging mechanism 206 through a hole in the end of the grip. In other words, the tool engages the engaging mechanism 206 through the butt end of the grip. In certain embodiments, the engaging mechanism is located within about 25.4 mm (1") of the end of the grip for easy access. In one embodiment, the top collar 208 is bonded, welded, mechanically attached, or adhesively attached to an inner surface of the upper end of the upper shaft 216. After inserting the engaging mechanism 206 into the top collar 208, the cap 204 is bonded, ultrasonically welded, mechanically attached, or adhesively attached to a top surface of the top collar 208 to retain the engaging mechanism 206 in a gap between the top collar 208 and cap 204.

FIG. 2B further shows the tubular key shaft 210 in engagement with the engaging mechanism 206 within the upper shaft 216. The tubular key shaft 210 extends along a majority of the upper shaft 216 length to connect with the locking insert 212. In one embodiment, the tubular key shaft 210 is an extruded square tube stock of aluminum, copper or brass although any material described herein can be utilized. The locking insert 212 receives the tubular key shaft 210 so that a rotation of the engaging mechanism 206 and tubular key shaft 210 causes the locking insert 212 to rotate also. In certain embodiments, the tubular key shaft 210 is press fit, bonded, or swaged into the engaging mechanism 206.

Moreover, the outer surface of the locking insert 212 includes a threaded region 230 that receives the locking collar 214. In one embodiment, a first rotational movement by the key shaft 210 causes the locking insert 212 to rotate while the locking collar 214 remains rotationally restrained or stationary. As the locking insert 212 rotates and engages the locking collar 214 with the threaded portion 230, the locking collar 214 moves in the second axial direction of the lower shaft 222. Even though the locking collar 214 is rotationally restrained, the locking collar 214 is able to move in an axial direction parallel with the centerline axis 226 while being rotationally restrained. A movement of the locking collar 214 in the second axial direction causes a portion of the locking collar 214 to engage or wedge between the inner surface of the lower shaft 222 and an outer surface of the locking insert 212 in a locking position. The friction created between the threaded region 230 of the locking insert 212 and the locking collar 214 during rotation is relatively low when compared to the friction between the outer surface of the locking collar 214 and the inner surface of the lower shaft 222. Thus, after locking, the adjustable golf club shaft 200 is ready for use. In other words, a force applied by the user on either the upper shaft 216 or the lower shaft 222 will not cause any movement between the upper shaft 216 and lower shaft 222 due to the locking mechanism 224.

In contrast, a second rotational movement by the key shaft 210 in an opposite direction of the first rotational movement causes the locking collar 214 to disengage from the inner surface of the lower shaft 222 and the locking insert 212. Therefore, the locking collar 214 will move in the first axial direction 116 with respect to the lower shaft 222. Thus, after unlocking, the adjustable golf club shaft 200 can be adjusted by the user to a desired position before re-engaging the locking collar 214.

FIG. 2B further shows a spacer or sleeve 220 that is located between the inner surface of the upper shaft 216 and an outer surface of the lower shaft 222. The spacer 220 maintains a gap between the lower shaft 222 and upper shaft 216 so that the lower shaft 222 can easily slide up or down within the upper shaft 216 with a relatively low amount of friction. The spacer 220 also prevents unnecessary wear between the two shafts 216,222 thereby enabling repetitive adjustment and prolonged use without unwanted wear.

Figure 2C:
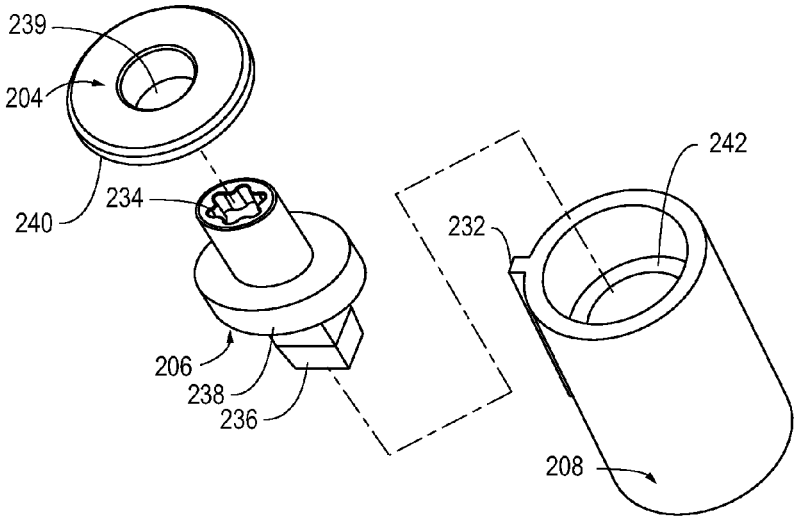
FIG. 2C is an exploded assembly view of an engaging assembly.

FIG. 2C illustrates an embodiment of an exploded view of the engaging mechanism assembly including the cap 204, engaging mechanism 206, and top collar 208. The top collar 208 is a cylindrical piece having a through bore and a counter-bore ledge 242 that receives the engaging mechanism 206. The top collar 208 also includes a key member 232 that extends along the length of the top collar 208 on an outer surface of the cylindrical shape. The key member 232 is received in a slot or recess located in the upper shaft 216 to prevent rotation of the top collar 208 during user rotation of the engagement mechanism 206 and to enhance the joining between the top collar 208 and shaft 216.

The engagement mechanism 206 includes a drive portion 234 that is a six-pointed drive. It is understood that the drive portion 234 can be a hex socket, phillips, slotted, TORX®, spline or other known drive configuration capable of receiving a driving tool. The engagement mechanism 206 further includes a cylindrical shoulder portion 238 located in a mid-portion of the engagement mechanism 206. The shoulder portion 238 engages with the counter-bore ledge 242 to retain the engagement mechanism 206 within the top collar 208. The lower end of the engagement mechanism 206 is a square key portion 236 that is received by the key shaft 210. It is further understood that the square key portion 236 can be any shape or type of key.

In addition, the cap 204 includes a center through-hole 239 having a diameter large enough to allow the drive portion 234 of the engagement mechanism 206 to protrude above a top surface of the cap 204. The cap 204 has a flange portion or lip 240 that is bonded, mechanically attached, or adhesively attached to a topmost surface of the top collar 208. In one embodiment, the cap 204 flange portion 240 and top collar seam or intersection is waterproof to prevent any liquid from entering the adjustable shaft interior. The cap 204 and top collar 208 perform an important function in retaining the engagement mechanism 206 while also sealing the top end of the upper shaft 216 from unwanted debris or liquids. In addition, the seam between the drive portion 234 and through-hole 239 side wall can be waterproof while still allowing the rotation of the engagement mechanism 206.

For example, a protective layer or cap of thermoplastic material can be initially molded around the drive portion 234 and top cap to provide further waterproofing or solvent-proofing during the manufacturing process of applying the grip cover 202 to the upper shaft 216. Upon receiving the final assembled product, the user might break through the thermoplastic with the engaging tool to allow the engagement mechanism 206 to be rotated by the tool.

Figure 2D:
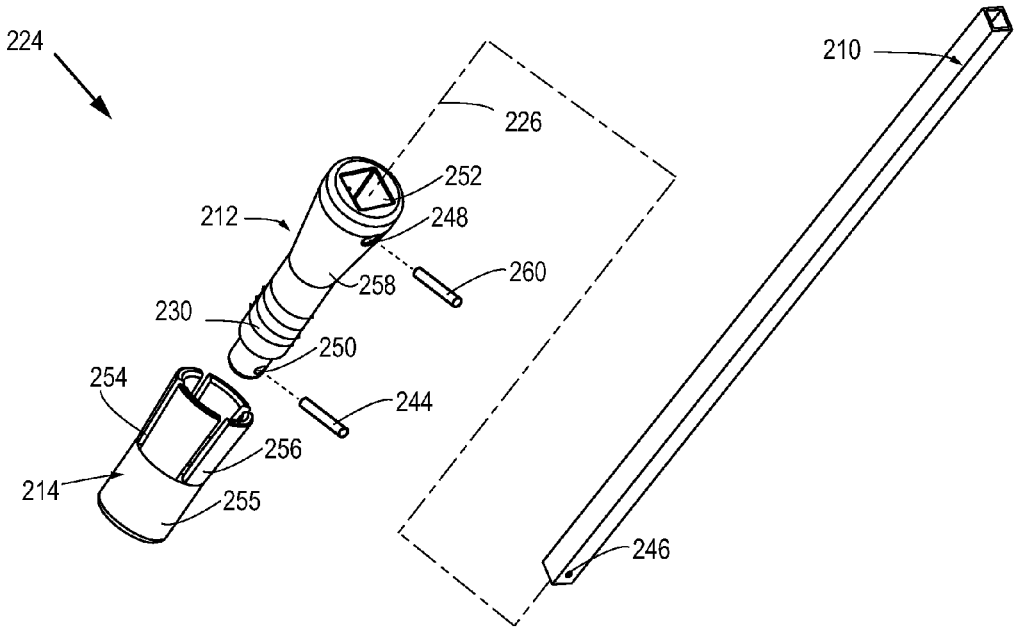
FIG. 2D is an exploded assembly view of a locking mechanism and key shaft.

FIG. 2D illustrates an exploded view of the locking mechanism assembly 224 in further detail, according to one embodiment. The key shaft 210 includes a shaft pinhole 246 to receive a first key pin 260, according to one embodiment. The locking insert 212 includes a square keyhole 252 to receive the key shaft 210 and a first pinhole 248 located on a locking insert 212 sidewall. The first pin 260 is inserted into the first pinhole 248 and shaft pinhole 246 to secure the key shaft 210 to the locking insert 212.

The locking insert 212 is received into the locking collar 214 and further includes a second pinhole 250 that receives the second pin 244. The second pin 244 ensures that the locking collar 214 is retained on a lower end of the locking insert 212 above the second pinhole 250. The first and second pins 260,244 can be press fit, adhesively or mechanically attached to the locking insert 212. The locking insert 212 also includes a threaded region 230 that threadably engages with a locking collar 214 through-hole 257 (in FIG. 2F). Furthermore, the locking insert 212 includes a tapered frusto-conical engagement surface 258 for engaging with the tab or finger portion 256 of the locking collar 214.

The locking collar 214 includes four tabs or finger portions 256 on an upper end of the locking collar 214. The finger portions 256 are formed by four slots 254 spaced equidistant from one another around a circumference of the locking collar 214. It is understood that certain embodiments can have more than two slots or at least four expandable finger portions without departing from the scope of this invention. At least one advantage of having at least four expandable fingers portions 256, is that it provides an equally distributed force about the circumference of the locking insert 212 and locking collar 214 while engaged in the locked position. In certain embodiments, the finger portions 256 can be biased outwardly away from the centerline axis 226 so that they will engage with the engagement surface 258 of the locking insert 212 as seen in FIG. 2E.

Figure 2E:
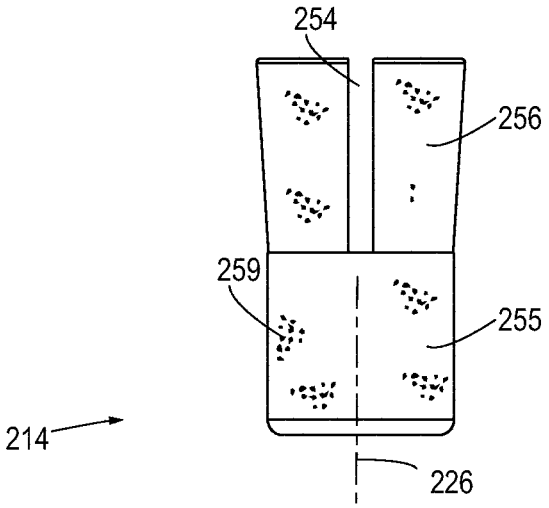
FIG. 2E is a side view of a locking collar.

FIG. 2E is an elevated side view of the locking collar 214, previously described. FIG. 2E further shows a frictional coating 259 that can be applied to the outer surface of the locking collar 214, as previously described. In one embodiment, the frictional coating 259 is a urethane or polyurethane coating.

Figure 2F:
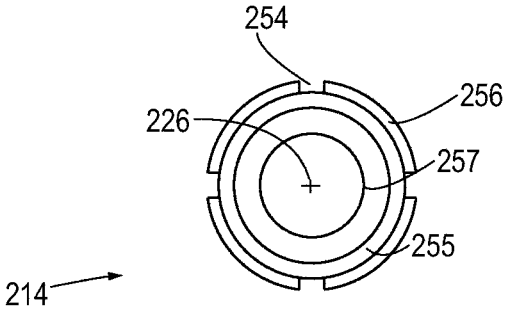
FIG. 2F is a top view of the locking collar of FIG. 2E.

FIG. 2F illustrates a top view of the locking collar 214 having the bore hole 257, finger portions 256, centerline 226, slots 254, and a base portion 255, as described above. The locking collar 214 further includes the base portion 255 being connected with the finger portions 256. The outer diameter of the base portion 255 and finger portions 256 are frictionally engaged with the inside diameter of the lower shaft 222. In order for the present invention to function properly, the locking collar 214 must be rotationally restrained within the inner shaft 222 during a rotation of the locking insert 212 while being allowed to move translationally along the centerline 226 axis. Therefore, it is critical that the coefficient of friction between the locking insert 212 and locking collar 214 is less than the coefficient of friction between the locking collar 214 and inner shaft 222.

In one embodiment, the locking collar 214 or locking insert 212 is comprised of a nylon material having a static coefficient of friction value of about 0.252. In another embodiment the locking collar 214 is comprised of a poly(tetrafluoroethylene) material (such as Teflon®) having a coefficient of friction value of about 0.05 or a polyoxymethylene material (such as Delrin®) having a coefficient of friction of about 0.192. In preferred embodiments, a material having a coefficient of friction of less than about 0.5 is preferred. In other preferred embodiments, a coefficient of friction of less than about 0.3 for the locking collar 214 or locking insert 212 is preferred. In another exemplary embodiment, the locking collar 214 can be an aluminum or low friction polished metallic material. It is understood that any low friction material described herein can be used without departing from the scope of the present invention.

In further embodiments, the locking collar 214 is a low friction material described above having an outer surface of the base portion 255 and/or finger portions covered in a high friction coating or spray. The friction coating or spray is provided to create increased rotational friction while allowing the collar to slide freely along an axial 226 direction. In one embodiment, the inside surface of the steel lower shaft 222 has a static coefficient of friction of about 0.80.

Figure 2G:
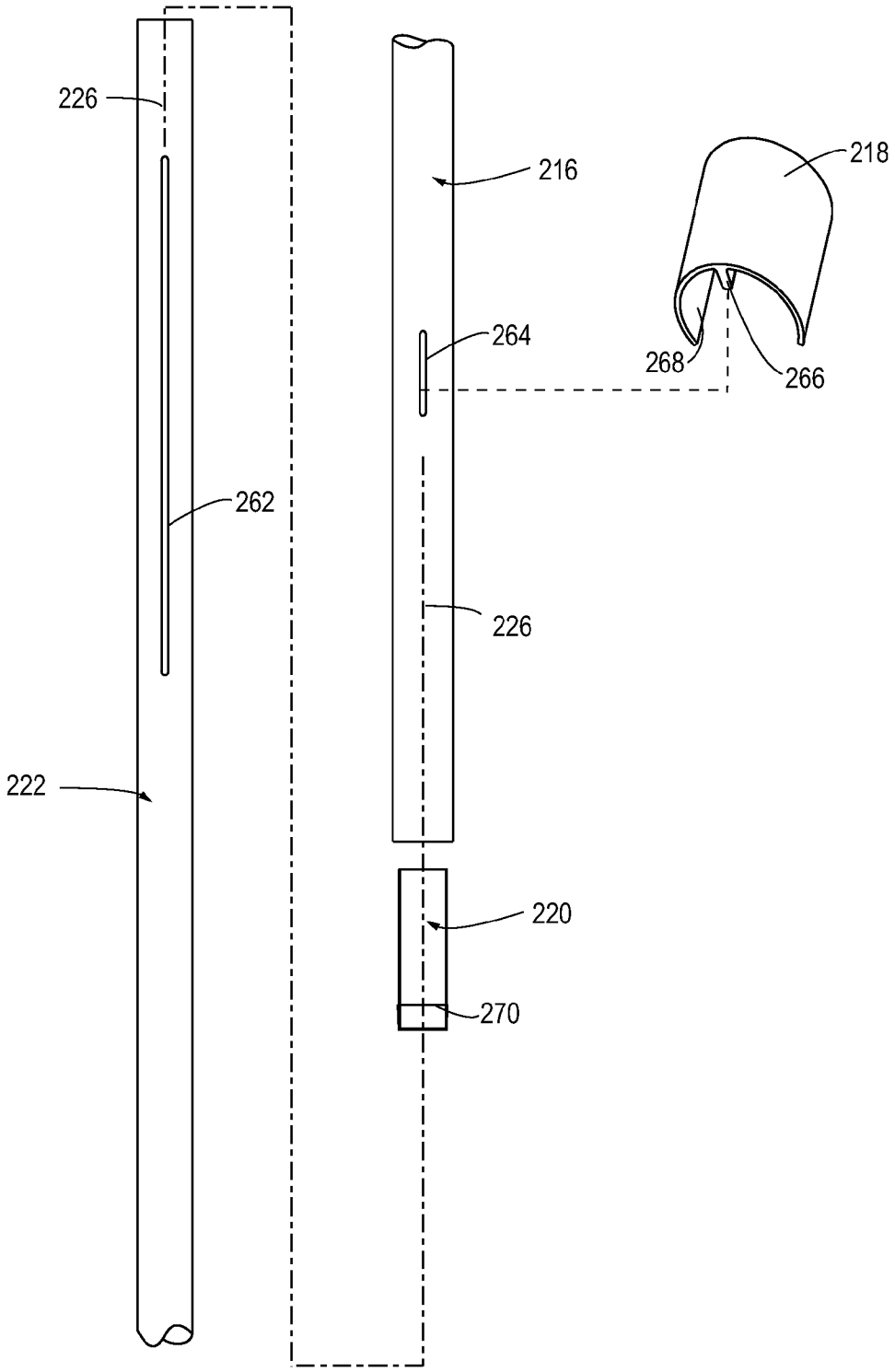
FIG. 2G is an exploded assembly view of a shaft and stop clip assembly.

FIG. 2G shows an assembly view of portions of the lower shaft 222 and the upper shaft 216 in greater detail. The spacer 220 is capable of being inserted into the upper shaft 216 while also receiving the lower shaft 222 to enable a telescopic engagement between the two shafts 216,222. In one embodiment, the spacer 220 is adhesively attached to the inside diameter of the upper shaft 216. In certain embodiments, the spacer 220 is a low friction material capable of sliding over the outside diameter of the lower shaft 222 and can be a material such as a polymer, plastic, polyoxymethylene, nylon or other low friction polymer material. A spacer ridge 270 is provided on the outside diameter of the spacer 220 to maintain the spacer 220 at the lower end of the upper shaft 216.

The stop clip 218 is also shown connecting the lower 222 and upper 216 shafts together by engaging with a lower shaft slot 262 and an upper shaft slot 264. In one embodiment, the lower shaft slot 262 is longer than the upper shaft slot 264 and is at least about 76 mm (3 inches) in length. In one embodiment, the upper shaft slot 264 is at least about 12.7 mm (½ inch). It is understood that in other embodiments, the lower shaft slot 262 can be shorter than the upper shaft slot 264. For example, the upper shaft slot 264 can be about 76 mm (3 inches) and the lower shaft slot 264 can be about 12.7 mm (½ inch).

In another embodiment, the lower shaft slot 262 is configured to allow the lower shaft 222 to travel at least 7.6 cm (3 inches) while accommodating the length of the stop clip 218. In some embodiments, the lower shaft 222 can travel at least 25.4 mm (1 inch) or between about 25.4 mm (1 inch) and 127 mm (5 inches). In other embodiments, the lower shaft 222 can travel between about 25.4 mm (1 inch) and 254 mm (10 inches). Depending on the type of putter, the lower shaft 222 can travel more than 254 mm (10 inches).

The stop clip 218 is shown having a semi-cylindrical shape and an inner surface 268 that conforms to a substantial portion of the outer surface of the outer shaft 216. In one embodiment, the inner surface 268 of the stop clip 218 extends around at least half of the circumference of the outer surface of the upper shaft 216 to ensure the stop clip 218 is fully engaged with the upper shaft 216. In one embodiment, an interior of the grip cover 202 can be notched or recessed to accommodate the thickness of the stop clip 218 to prevent grip bulging. The primary purpose of the stop clip 218 is to prevent rotation of the telescoping shafts. In other words, only one degree of freedom is allowed between the two telescoping shafts. Another purpose of the stop clip 218 is to limit translational travel along the centerline axis of the shafts. Furthermore, in some embodiments, the stop clip 218 can limit rotational freedom of the club head as described in further detail below.

FIG. 2G further shows the upper shaft slot 264 is configured to receive a stop clip rib 266 protruding from the inner surface 268 of the stop clip 218. The stop clip rib 266 extends along the length of the stop clip 218 and also is received by the lower shaft slot 262 upon engagement with the upper shaft slot 264. The stop clip rib 266 and upper shaft slot 264 prevents movement between the upper shaft 216 and the stop clip 218.

In certain embodiments, the width of the lower shaft slot 262 is at least about 1.5 mm (0.06") wide. However, the lower shaft slot 262 can be a wider slot designed to allow the user to rotate the lower shaft 222 in order to create a 2° open face or a 2° closed face with respect to a neutral position. In an embodiment where the lower shaft 222 has a slight amount of rotational freedom, the stop clip 218 and slot allows the lower shaft 222 to rotate with respect to the upper shaft thereby providing the ability to manipulate club head face angle. In one embodiment, the stop clip 218 and slot arrangement enables between about 1°-4° of rotational freedom for the club head. In certain embodiments, more than about 4° of rotational freedom for the club head can be provided. The stop clip 218 allows a user to adjust the face angle of the putter head.

In use, a user rotates the engagement mechanism 206 with a tool. The engagement mechanism 206 in turn rotates the locking insert 212. The rotation of the locking insert 212 causes the locking collar 214 to move in a second axial direction 118 where the finger portions 256 wedge between the locking collar 214 and lower shaft 222 to create a locking fit. In order to unlock the locking mechanism 224, the user rotates the engagement mechanism 206 in the opposite direction to push the locking collar 214 in the first axial direction thereby disengaging the finger portions 256 from the gap between the engaging surface 258 of the locking insert 212 and the lower shaft 222. A user may then adjust the length of the club 100 and re-lock the locking mechanism 224.

Figure 3A:
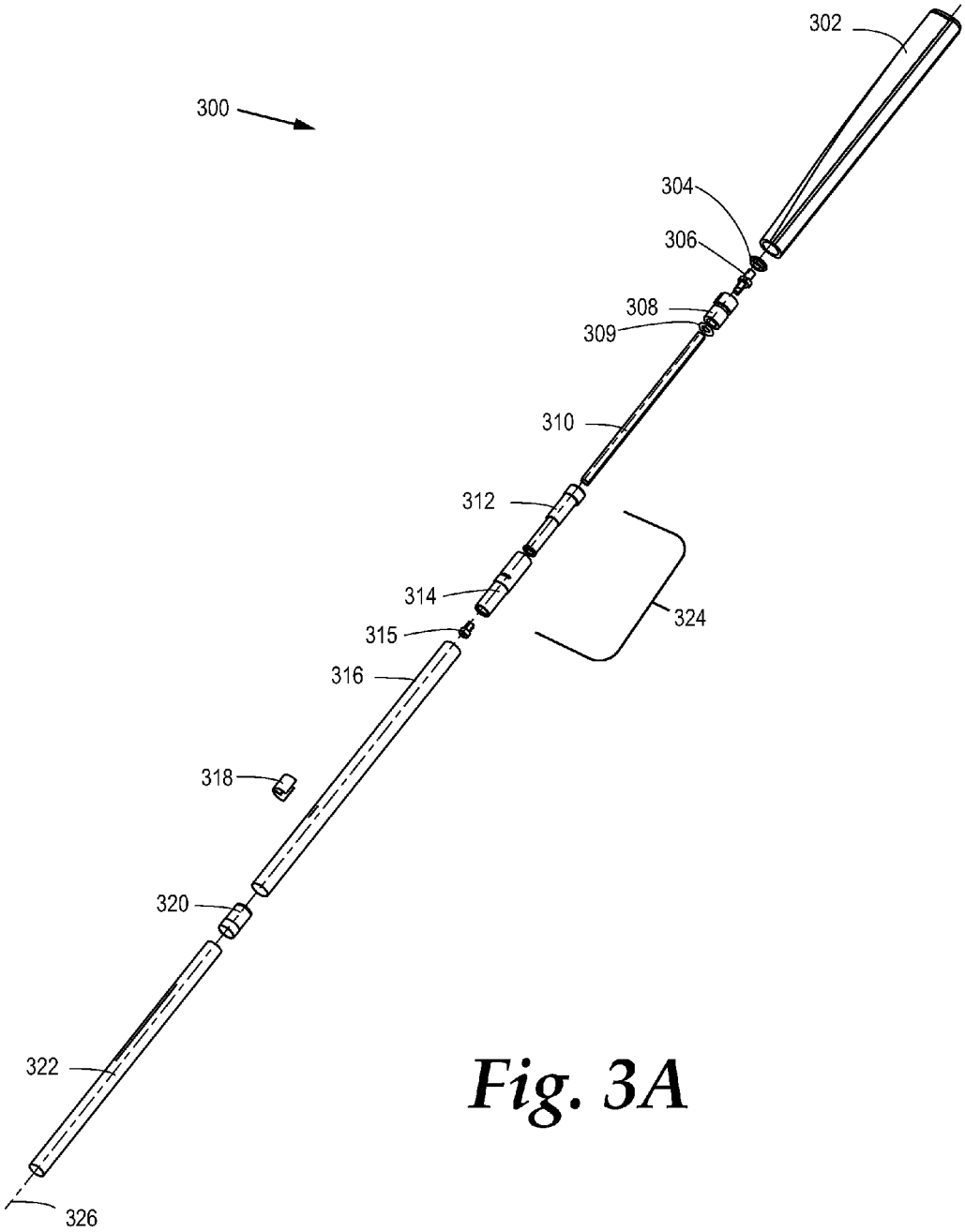
FIG. 3A is an exploded assembly view of an adjustable shaft according to a second embodiment.

FIG. 3A illustrates an exploded assembly view of an exemplary adjustable golf club shaft 300, according to another embodiment. The adjustable golf club shaft 300 includes a grip cover 302, a cap 304, an engaging mechanism 306, a top collar 308, a spacer ring 309, a tubular key shaft 310, a locking insert 312, a locking collar 314, a stop plug 315, an upper shaft 316, a stop clip 318, a spacer 320, a lower shaft 322, and a centerline axis 326. The locking insert 312 and locking collar 314 comprise a locking mechanism 324. Furthermore, the grip cover 302 and upper shaft 316 comprise a grip portion.

Figure 3B:
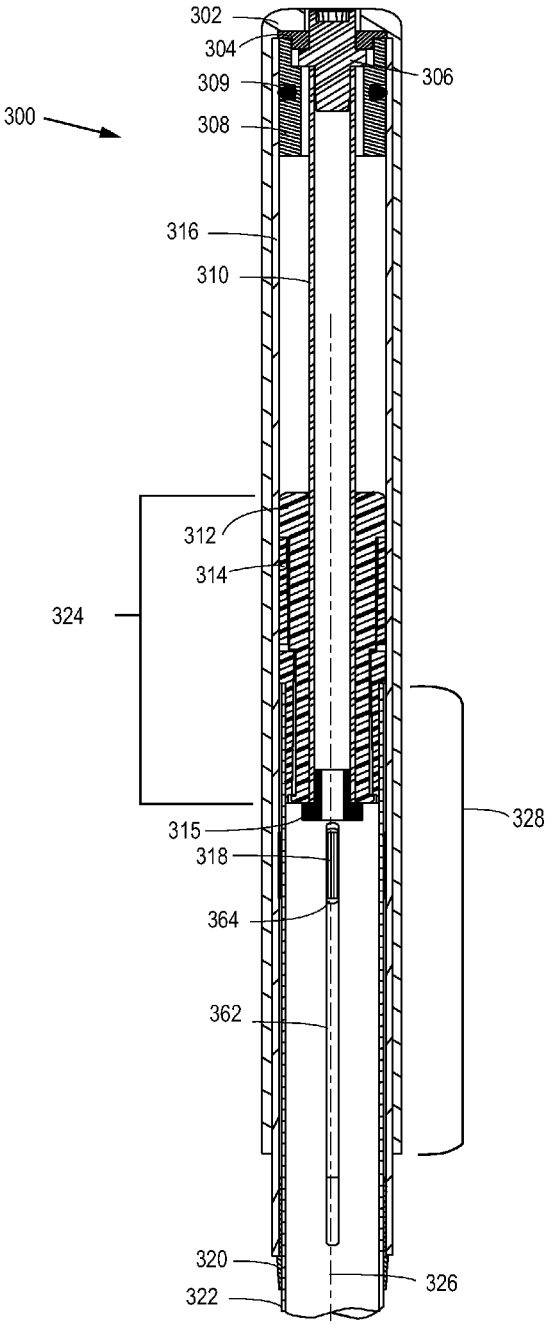
FIG. 3B is a cross-sectional assembled view of the adjustable shaft of FIG. 3A.

FIG. 3B shows a cross-sectional view of the adjustable golf club shaft 300. As similarly described above, the cap 304, engaging mechanism 306, and top collar 308 form an engaging assembly. The spacer ring 309 secures the top collar 308 in the upper shaft to prevent rattle and lateral movement of the top collar while also providing some waterproofing advantages. The engaging mechanism 306 is connected with the key shaft 310 on a first end and rotates the key shaft 310 upon a user input. The key shaft 310 is axially received by the locking mechanism 324. The key shaft 310 is connected with the stop plug 315 at a second end that is opposite the first end. The locking mechanism 324 freely slides along the key shaft 310 in an axial direction when unlocked.

FIG. 3B further shows the locking mechanism 324 being bonded, welded, or adhesively attached to the lower shaft 322. Specifically, the outside diameter of the locking collar 314 is fixedly attached to the inside diameter of the lower shaft 322.

FIG. 3B also shows the lower shaft 322 extended in a maximum extended position. In the extended position, the bottom surface of the locking insert 312 engages with the stop plug 315 preventing the lower shaft 322 from traveling any further in the downward axial direction 116. In addition, the stop clip 318 engages a top end of the lower shaft slot 362 to limit further axial movement and to prevent the lower shaft 322 from rotating with respect to the upper shaft 316. In other words, the travel of the lower shaft 322 within the upper shaft 316 is restricted by both the stop plug 315 and the stop clip 318 in the overlap region 328. However, the locking action of the locking mechanism 324 occurs outside of the overlap region 328 in the upper shaft 316.

FIG. 3B incorporates a similar stop clip 318 and slot arrangement previously described in FIG. 2G. The lower shaft 322 includes a lower shaft slot 362 and the upper shaft 316 includes an upper shaft slot 364. Both the upper and lower shaft slots 362,364 receive the stop clip 318 as previously described. A sleeve 320 is also provided between the upper shaft 316 and lower shaft 322 to facilitate a smooth sliding engagement between the two shafts and to cover a portion of the lower shaft slot 362.

Figure 3C:
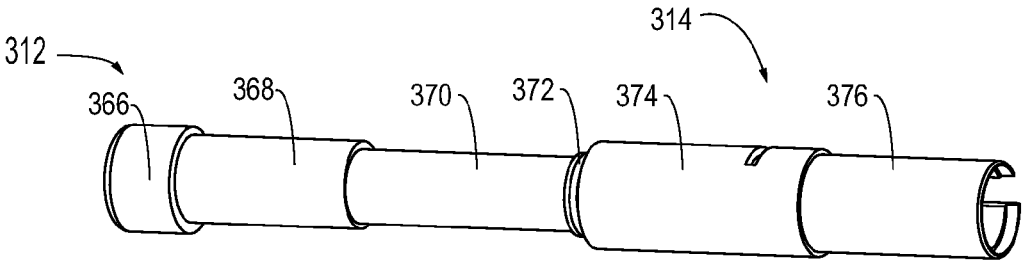
FIG. 3C is an exploded assembly view of a locking mechanism.

FIG. 3C shows an unassembled view of the locking insert 312 and locking collar 314. The locking insert 312 includes a top 366, middle 368, and lower 370 cylindrical portion. The top 366, middle 368, and lower 370 cylindrical portions are decreasing in diameter so that the top portion 366 has the largest diameter while the lower portion 370 has the smallest diameter. The lower cylindrical portion 370 includes a lip 372 that engages with the stop plug 315 as previously described. The lip 372 also retains the locking insert 312 within the locking collar 314 to prevent the removal of the locking insert 312 from the locking collar 314 in an axial direction upon assembly.

The locking collar 314 includes a top region 374 and a bottom region 376. The top region 374 has a larger diameter than the bottom region 376 and is large enough to receive the middle portion 368 of the locking insert 312. Furthermore, the bottom region 376 of the locking collar 314 is large enough to accommodate the diameter of the lower portion 370 of the locking insert 312.

Figure 3D:
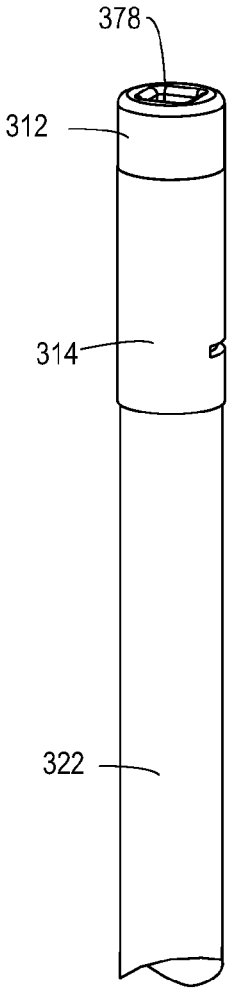
FIG. 3D is an assembled view of a locking mechanism and lower shaft.

FIG. 3D shows an assembled view of the locking insert 312 and locking collar 314. The bottom edge of the top portion 366 of the locking insert 312 engages with the top edge of the top region 374 of the locking collar 314. The middle 368 and bottom 370 portions of the locking insert 312 are primarily contained and received within the top 374 and bottom 376 regions of locking collar 314, respectively. The locking insert 312 includes a key hole opening 378 that extend through the entire body of the locking insert 312 and meshes with the key shaft 310. The bottom region 376 of the locking collar 314 is inserted into the lower shaft 322 and the lip 372 engages the lower edge of the locking collar 314 to prevent removal, as previously mentioned. The bottom region 376 of the locking collar 314 is bonded or adhesively attached to the inner diameter of the lower shaft 322. Alternatively, it is understood that a mechanical attachment can also be created.

Figure 3E:
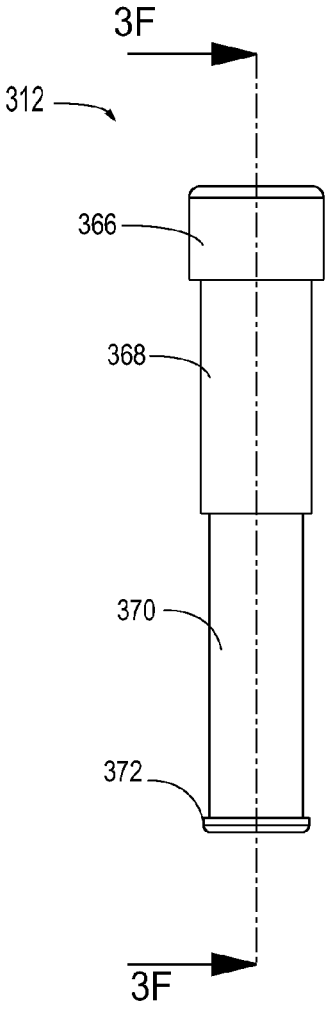
FIG. 3E is front perspective view of a locking insert.
Figure 3F:
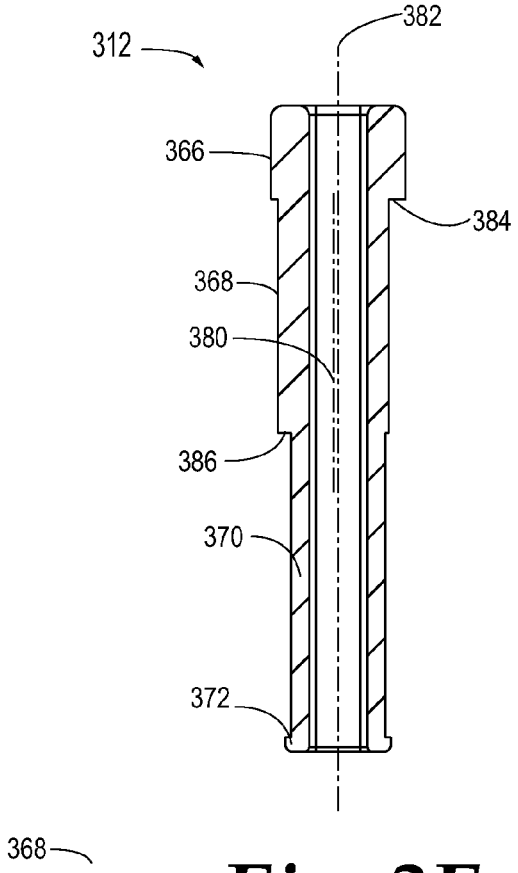
FIG. 3F is a cross-sectional view of the locking insert taken along section lines 3F-3F in FIG. 3E.

FIG. 3E shows a front view of the locking insert 312 having the top 366, middle 368, and lower 370 cylindrical portions described above. FIG. 3F is a cross-sectional view of the cylindrical portions along the cross-sectional lines 3F-3F in FIG. 3E.

FIG. 3F shows the top portion 366 having a bottom circular edge 384. The outside diameter of the top portion 366 is concentric with respect to the outside diameter of the lower portion 370. The middle portion 368 has a non-concentric bottom circular edge 386 having a second centerline axis 380 that is non-coaxial with the first centerline axis 382. In other words, the top portion 366 and the lower portion 370 share the same first centerline axis 382 and are concentric with one another. However, the middle portion 368 has an offset second centerline axis 380 and has a circumference that is non-concentric with the circumference of the top portion 366 and lower portion 370.

Figure 3G:
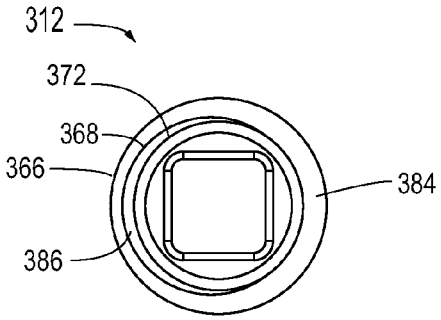
FIG. 3G is a bottom perspective view of the locking insert.

FIG. 3G is a bottom perspective view of the locking insert 312. FIG. 3G further shows the non-concentric nature of the middle portion 368 as described above.

Figure 3H:
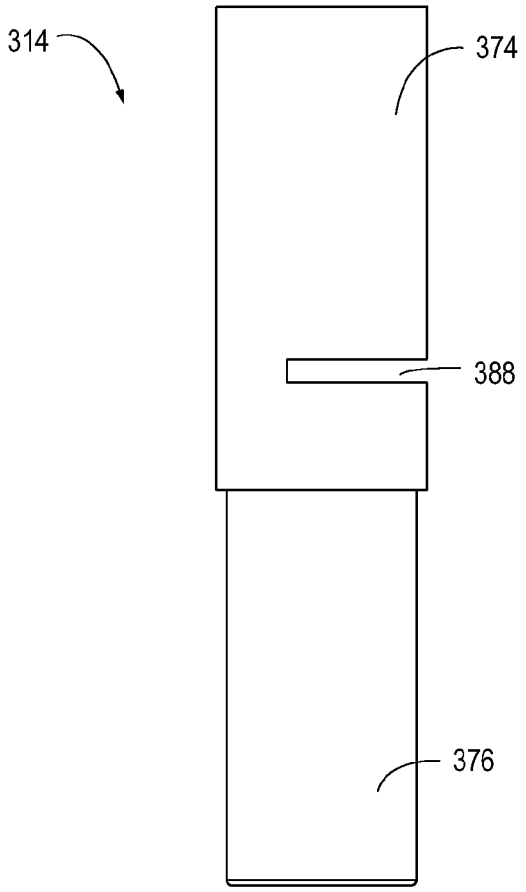
FIG. 3H is a side perspective view of a locking collar.

FIG. 3H is a side view of the locking collar 314 having a first slotted region 388 extending through more than half the diameter of the top portion 366 in a direction transverse to the axial direction.

Figure 3I:
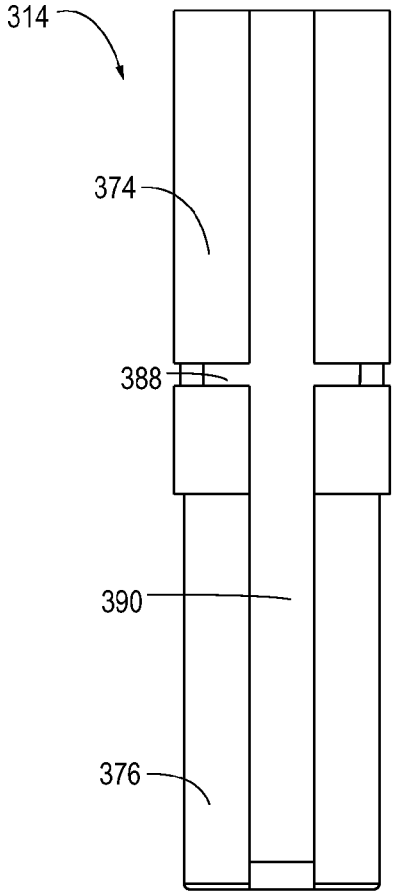
FIG. 3I is a front perspective view of the locking collar of FIG. 3H.

FIG. 3I is a front view of the locking collar 314 having the slotted region 388 and a second slotted region 390. The second slotted region 390 extends in a direction parallel with the centerline axis and along the entire length of the locking collar 314.

Figure 3J:
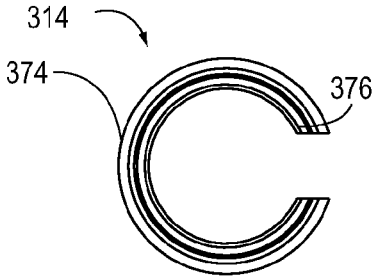
FIG. 3J is a bottom perspective view of the locking collar of FIG. 3H.

FIG. 3J is a bottom view of the locking collar 314 having a top region 374 and bottom region 376 as previously described.

Figure 3K:
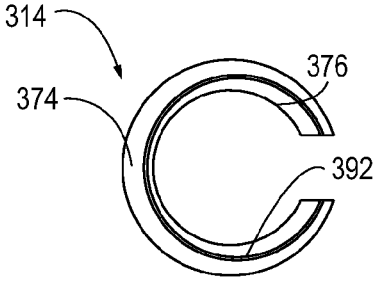
FIG. 3K is a top perspective view of the locking collar of FIG. 3H.

FIG. 3K shows a top view of the locking collar 314 where the inner circumference 392 of the top region 374 is a non-concentric inner circumference that matches the outer circumference of the middle portion 368 of the locking insert 312 when the locking insert is in a first unlocked position.

Figure 3L:
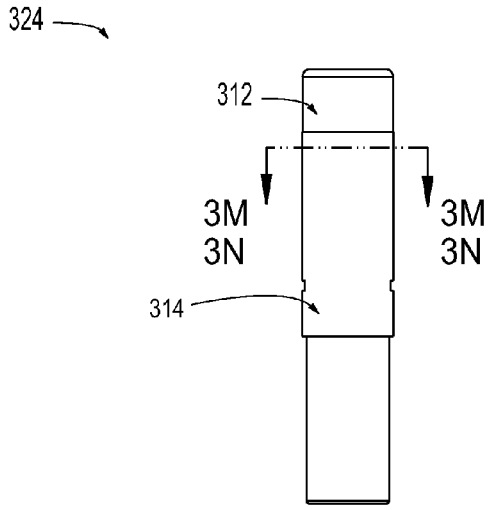
FIG. 3L is a rear perspective view of an assembly of the locking insert and locking collar.

FIG. 3L shows a rear view of the locking insert 312 and locking collar 314 assembly prior to being inserted into the lower shaft 322.

Figure 3M:
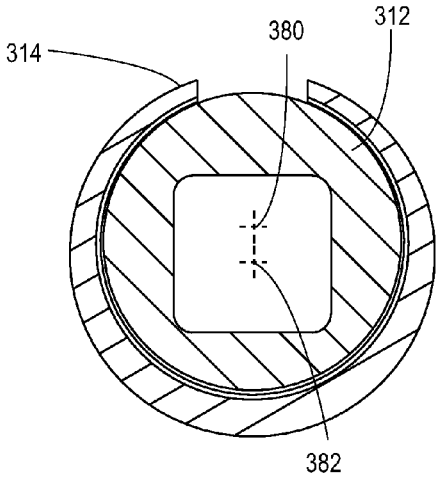
FIG. 3M is a cross-sectional view of the locking insert and locking collar assembly in an unlocked position taken along section lines 3M-3M of FIG. 3L.

FIG. 3M shows a cross-sectional view taken along the sectional lines 3M-3M in FIG. 3L. FIG. 3M generally shows the locking insert 312 in the first unlocked position where the circumference of the middle portion 368 of the locking insert 312 matches with the inner surface 392 circumference of the top region 374 of the locking collar 314. In the first unlocked position, the top region 374 of the locking collar is not bent or flexed. Furthermore, in the unlocked position, the second centerline axis 380 is shown to be above the first centerline axis 382.

Figure 3N:
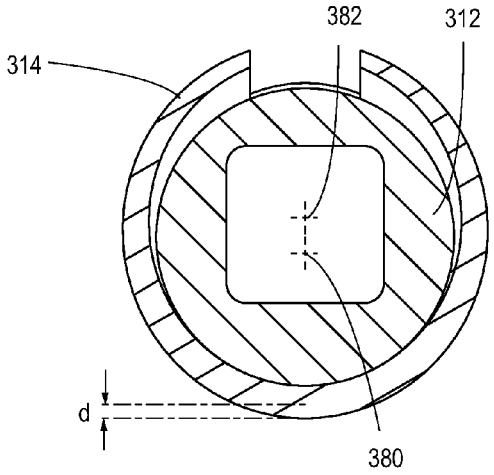
FIG. 3N is a cross-sectional view of the locking insert and locking collar assembly in a locked position taken along section lines 3N-3N of FIG. 3L.

FIG. 3N shows a cross-sectional view taken along the sectional lines 3N-3N in FIG. 3L. FIG. 3N shows the locking insert 312 orientation after being rotated about 180° to the locked position from the first unlocked position shown in FIG. 3M. In the locked position, the middle portion 368 of the locking insert 312 pushes against the inner surface 392 of the locking collar 314 to bend or flex the top region 374 of the locking collar 314 a distance, d. The middle portion 368 of the locking insert 312 can be described as a cam mechanism that engages with the locking collar 314 and upper shaft 316. The bending or flexing of the top region 374 of the locking collar 314 by a distance, d, causes the top region 374 of the locking collar to engage in an inner surface of the upper shaft 316 and thereby locking the lower shaft 322 with respect to the upper shaft 316. In the locked position, the second centerline axis 380 is rotated 180° about the first centerline axis 382 to the locked position.

Figure 4:
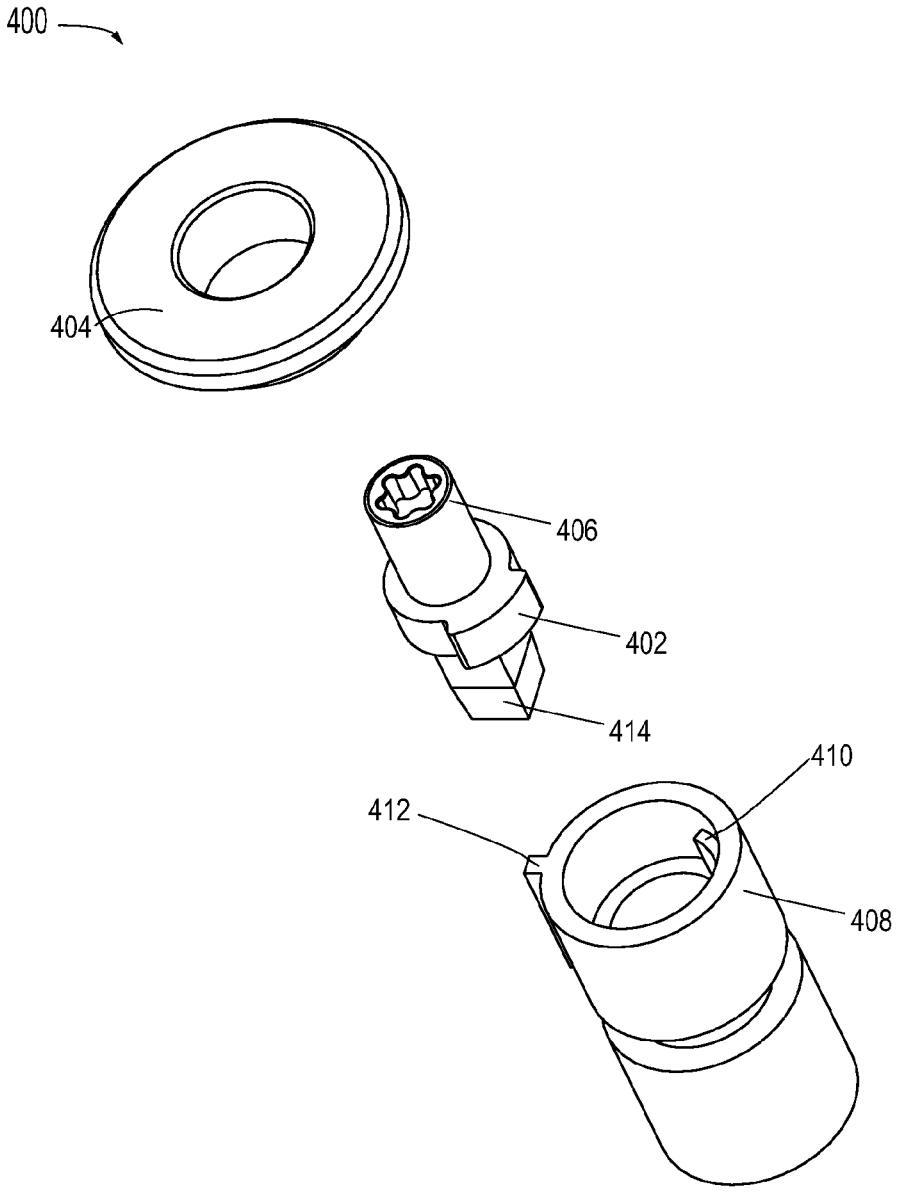
FIG. 4 is an exploded view of an engaging assembly.

FIG. 4 shows an exploded assembly of an exemplary engaging assembly 400 that can be implemented in any of the embodiments previously described. The engaging assembly 400 includes a cap 404, engagement mechanism 406, square key 414, and top collar 408. The engagement mechanism 406 includes a detent or protrusion 402 that engages a stop tab 410 located on an inner surface of the top collar 408. The detent or protrusion 402 prevents the engagement mechanism 406 from rotating beyond 180° upon engagement with the stop tab 410. Of course, it is understood that the detent or protrusion 402 can be designed to limit rotation to more or less than 180°.

The top collar 408 includes a rib 412 that contacts the inner surface of the upper shaft 316 to ensure a secure fit and prevent rotation of the top collar 408. In certain embodiments, the upper shaft 316 can be slotted to receive the rib 412 for preventing rotation.

Figure 5:
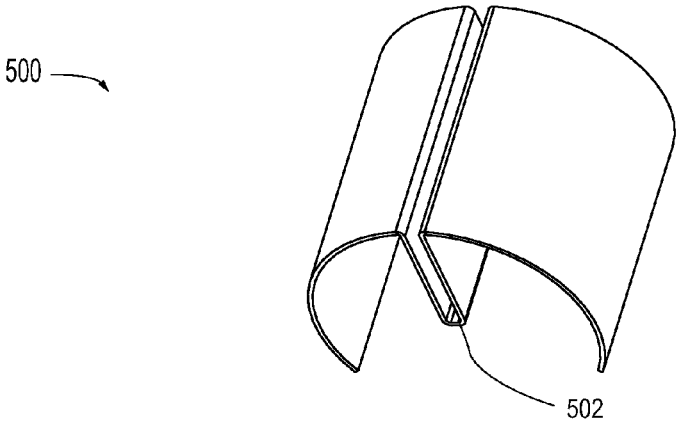
FIG. 5 is an isometric view of a stop clip.

FIG. 5 illustrates a stop clip 500 that can be implemented in any of the embodiments described above. The stop clip 500 is a semi-circular shape with a protruding portion 502 that can be received by slots provided in the upper and lower shafts described herein. In one embodiment, the stop clip 500 is a single piece of metallic material that is bent or pressed into a desired contour or shape.

In use, a user engages the engagement mechanism 406 with a tool (not shown). As the user rotates the engagement mechanism 406, the key shaft 310 is also rotated to cause the locking insert 312 to rotate. Due to the detent 402 and stop tab 410, the user is only able to rotate the engagement mechanism 406 less than one full rotation. After rotating 180°, the locking insert 312 moves from an unlocked position to a locked position as seen in FIGS. 3M and 3N. The locking insert 312 flexes or slightly bends at least a portion of the locking collar 314 by a distance, d. The flexing of the locking collar 314 essentially increases the overall diameter of the locking mechanism 324 to create an engagement with the inner surface of the upper shaft 316. To disengage the locking mechanism 324, the user rotates the engaging mechanism 324 in an opposite direction to an unlocked position.

Figure 6A:
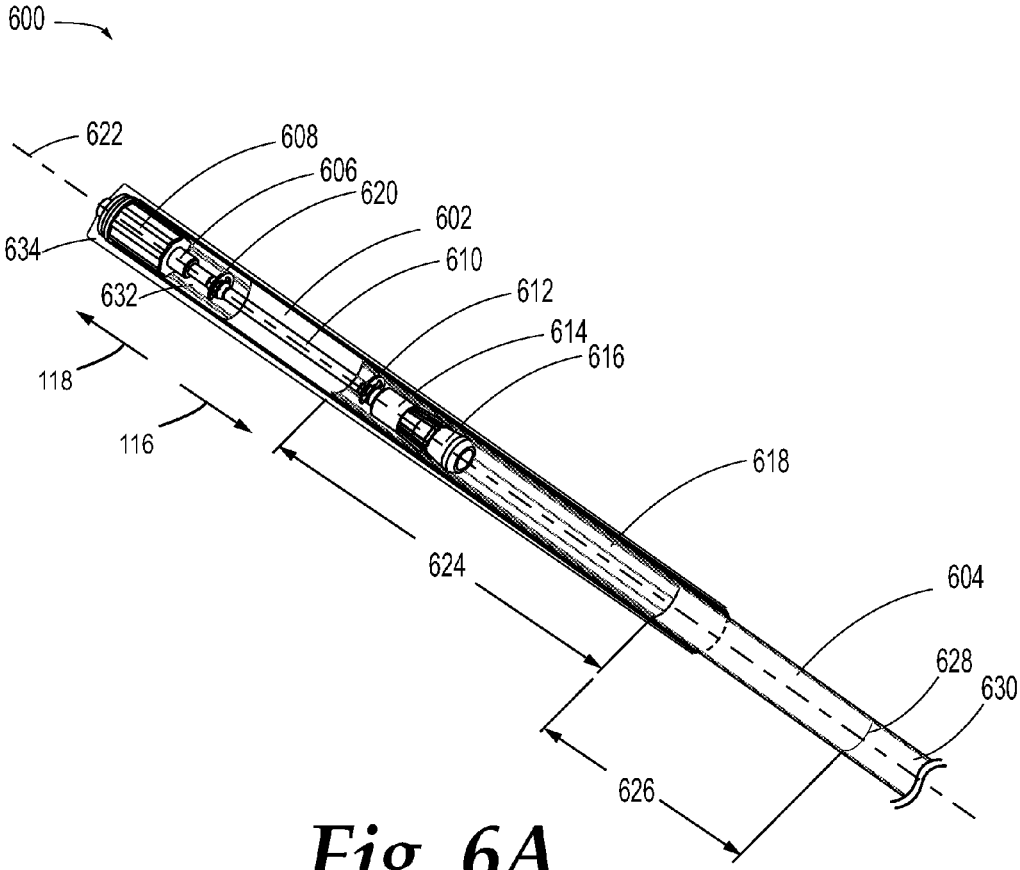
FIG. 6A is an assembled view, according to a third embodiment.

FIG. 6A illustrates another embodiment of an adjustable putter shaft assembly 600. FIG. 6A shows a cross-sectional assembly view of an adjustable shaft assembly with a cross-sectional portion of the grip 634, the upper shaft 602, and lower shaft 604 removed for clarity. As previously described, a first axial direction 116 and a second axial direction 118 are also shown being parallel with a shaft axis 622. The adjustable shaft assembly includes an engaging mechanism 606, a top collar 608, a rotational shaft 610, a first clip 620, a second clip 612, a locking collar 614, and a locking insert 616.

The lower shaft 604 includes a faceted or keying section 618, located on at least an interior diameter of the lower shaft 604, that engages with a portion of the outer surface of the locking collar 614. The keying section 618 extends along the shaft axis 622 a keying distance 624 of between about 1" and about 10" depending on the desired amount of adjustability and travel. The keying section 618 is located in an upper most portion of the lower shaft 604 although it is understood that the keying section can be located lower depending on the length of the rotational shaft 610. As shown, the keying section 618 begins at the upper end of the lower shaft 604.

For example, in one exemplary embodiment, the target amount of adjustability is about 3", therefore, the corresponding keying section 618 must have a keying distance 624 greater than 3" (the target amount of adjustability) in order for the user to have at least 3" of adjustability. However, a keying section 618 is desirably up to 2" to 4" longer than the amount a user can adjust the shaft. In one embodiment, the keying section 618 is about 4" to about 7" for a comfortable user adjustability distance of about 3". In other words, the keying section 618 is about 1" to about 4" longer than the amount of user adjustability. In some embodiments, the keying section 618 is between about 1" to about 2" longer than the amount of user adjustability.

FIG. 6A further shows a parallel section 626 of the lower shaft 604 where the lower shaft 604 circumference wall is substantially parallel with the shaft axis 622 in a direction along the shaft axis 622. In general, the parallel section 626 includes a constant radius or diameter and does not taper. The parallel section 626 is located immediately adjacent to the keying section 618. An end region 628 is shown where the parallel section 626 ends and the lower shaft 604 begins to transition to a taper section 630 where the shaft diameter begins to decrease or taper toward a club head attachment end (not shown in this view).

The upper shaft 602 also includes an upper keying section 632 that includes a faceted or scalloped interior surface for keying engagement with the top collar 608. The keying engagement between the top collar 608 and the upper keying section 632 prevent the rotation of the top collar 608 during a user rotational force applied to the engaging mechanism 606. In one embodiment, the upper shaft 602 is a graphite composite material that is lightweight in contrast to the lower shaft 604 which is a metal material such as steel. The grip portion 634 is a lightweight rubber or elastic material cover. The lightweight upper shaft 602 provides the user with the feel of a standard non-adjustable grip and shaft.

A first clip 620 and second clip 612 (or C-clips) are located between the top collar 608 and the locking collar 614. The first clip 620 is located on an upper end of the rotational shaft 610 while the second clip 612 is located on a lower end of the rotational shaft 610. In one embodiment, both clips are C-clips that engage in a circumferential groove located on the rotational shaft 610. The first clip 620 prevents the engaging mechanism 606 and rotational shaft 610 (which is adhesively or mechanically attached to the engaging mechanism 606) from sliding in a second axial direction 118. The top collar 608 is adhesively attached to the upper shaft 602, however, the engaging mechanism 606 is freely slidable and rotational with respect to the top collar 608. However, the grip portion 634 would prevent the unwanted movement of the rotational shaft 610 and engaging mechanism 606 in the second axial direction 118. The grip portion 634 generally covers the end portion of the shaft and includes an aperture for a user to access to the engaging mechanism, as described previously.

However, in the event that the grip portion 634 fails to prevent axial movement of the rotational shaft 610 with respect to the upper shaft 602, the first clip 620 would engage with the top collar 608 (which is fixed) to prevent the assembly from moving any further in the second axial direction 118.

The second clip 612 prevents the locking collar 614 from becoming detached from a threaded portion of the locking insert and excessively moving in the second axial direction 118.

In use, from a locked position, a user would utilize a wrench or tool to rotate the engaging mechanism 606. A rotation of the engaging mechanism 606 would cause the rotational shaft 610 and locking insert 616 to rotate. In one embodiment, the locking insert 616 and rotational shaft 610 are part of a single piece or are unrotatable with respect to each other. Thus, as the locking insert 616 is rotated, the threads located on the locking insert 616 are engaged with the locking collar 614. However, because the locking collar 614 is keyed to the keying section 618 of the lower shaft 604, the locking collar 614 does not rotate but moves primarily in an axial direction due to the threaded engagement with the rotating locking insert 616.

For example, if the locking insert is rotated in an unlocking direction, the locking collar will slide axially (not rotationally) in the second axial direction 118 to disengage the fingers of the locking collar 614 from the locking insert 616 so that a radial force is no longer applied to the interior surface of the lower shaft 604. Thus, the user can easily move the upper shaft 602 with respect to the lower shaft 604 to a desired length. As previously mentioned, the axial movement of the locking collar 614 is limited by the second clip 612.

In the unlocked position, the upper shaft 602, the engaging mechanism 606, the top collar 608, the rotational shaft 610, the locking collar 614, locking insert 616, and grip portion 634 all move together with respect to the lower shaft 604 during adjustment.

When the user has reached a final desired position, the user rotates the engaging mechanism 606 in a locking direction to cause the locking collar 614 to engage with the locking insert 616 threads to move the locking collar 614 in a first axial direction 116. As the locking collar 614 moves in the first axial direction 116 (but does not rotate due to the keying section 618 and the keyed our surface of the locking collar 614), the fingers of the locking collar 614 engage the sloped surface of the locking insert 616 causing a wedging force between the locking collar 614 and the interior surface 618 of the lower shaft 604. The wedging force created prevents the relative movement between the upper shaft 602 and lower shaft 604 thereby resulting in a locked position.

Figure 6B:
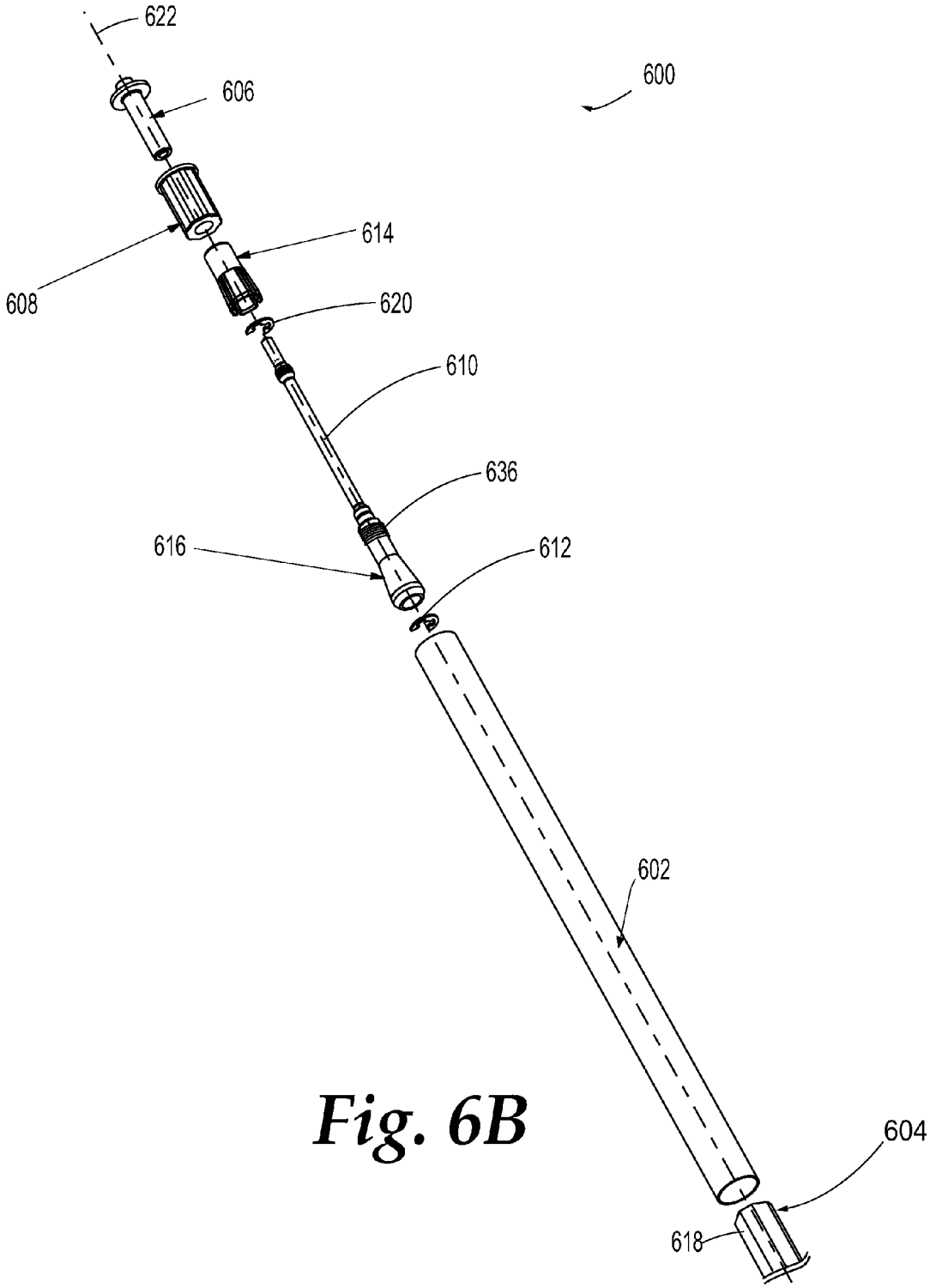
FIG. 6B is an exploded assembly of the adjustable shaft shown in FIG. 6A.

FIG. 6B illustrates an exploded assembly view of the engaging mechanism 606, the top collar 608, the locking collar 614, the first clip 620, the second clip 612, the rotational shaft 610, the locking insert 616, the upper shaft 602, the lower shaft 604, and a lower shaft keying section 618. The threaded portion 636 that the locking collar 614 engages is also shown more clearly.

Figure 7A:
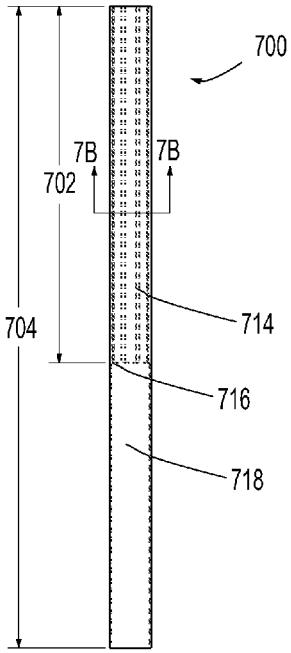
FIG. 7A is a side view of an upper shaft.

FIG. 7A illustrates an exemplary embodiment of an upper shaft 700 as used in an assembly similar to that shown in FIGS. 6A and 6B. The interior surface of the upper section is keyed for a keying distance 702 relative to the entire upper shaft length 704. In one embodiment, the ratio of the keying distance 702 to the entire upper shaft length is about 0.50 or less or between about 0.05 to about 0.50. In some embodiments, the keying distance 702 is between about 6.35 mm (0.25") to about 381 mm (15") or between about 76.2 mm (3") to about 177.8 mm (7"). In one embodiment, the entire upper shaft length is between about 127 mm (5") to about 508 mm (20") or between about 127 mm (5") to about 381 mm (15").

A first shoulder portion 716 is located on an interior surface of the shaft 700 where the upper shaft keying section 714 ends and a non-keyed portion 718 begins.

Figure 7C:
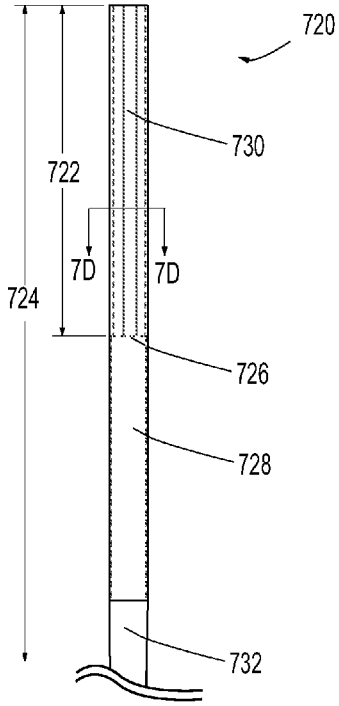
FIG. 7C is a side view of a lower shaft.
Figure 7B:
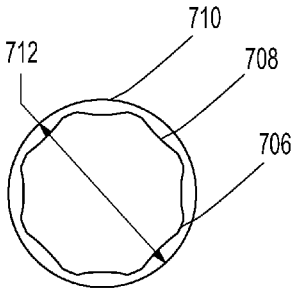
FIG. 7B is a cross-sectional view taken along section lines 7B-7B of FIG. 7A.

FIG. 7B illustrates a cross-sectional view along cross-sectional lines 7B-7B shown in FIG. 7A. The interior surface is keyed having a flat portion 708 (or slightly curved) and an intersection or apex region 706 where two flat portions 708 meet. The exterior surface 710 of the upper shaft 700 is smooth but can also be keyed having the same interior octagonal or polygonal geometry if desired. The overall diameter 712 of the upper shaft 700 is constant in one embodiment but can also be tapered. In one example, the overall diameter 712 of the upper shaft 700 is between about 10 mm (0.4") and about 25.4 mm (1") or between about 12.7 mm (0.5") and about 20 mm (0.8").

FIG. 7C illustrates an exemplary embodiment of a lower shaft 720 configured to be in telescopic sliding engagement with the upper shaft 700. The lower shaft 720 includes a lower non-keyed portion 728, a keyed portion 730, a keying distance 722 and an overall lower shaft length 724.

The lower shaft keyed portion 730 engages with the upper shaft keying section 714 to prevent a relative rotation of the lower shaft within the upper shaft during adjustment. It is possible for a user to completely remove the lower shaft and rotationally reorient the keying sections relative to one another so that a slightly open club face or slightly closed club face is achieved. It is important to note that the upper shaft keying section distance 702 is preferably equal to or greater than the lower shaft keying distance 722 in order to ensure proper shoulder 716 to shoulder 726 engagement.

If the lower shaft keying distance 722 is greater than the upper shaft keying distance 702, the upper end of the lower shaft may undesirably contact the top collar when the lower shaft is fully retracted within the upper shaft. Such undesirable contact with the top collar may cause damage to the top collar or even cause the top collar to be pushed out of the end of the upper shaft 700.

In one embodiment, a second shoulder portion 726 can be provided in the transition area between the keyed portion 730 and non-keyed portion 728. The second shoulder portion 726 can engage with the upper shaft first shoulder portion 716 in order to prevent the movement of the lower shaft 720 within the upper shaft 700 along the second axial direction 118. The shoulder engagement can act as a stop although a design where the shoulders 716,726 do not engage is also possible but may encounter the problems discussed above.

In one embodiment, the ratio of the lower shaft 720 keying distance 722 to the entire lower shaft length is about 0.50 or less or between about 0.01 to about 0.40. In some embodiments, the keying distance 722 is between about 6.35 mm (0.25") to about 254 mm (10") or between about 76.2 mm (3") to about 177.8 mm (7"). In one embodiment, the entire lower shaft length is between about 635 mm (25") to about 1168.4 mm (46") or between about 711.2 mm (28") to about 787.4 mm (31"). As described previously, the lower portion 732 of the lower shaft 720 tapers in diameter moving in an axial direction toward the club head.

Figure 7D:
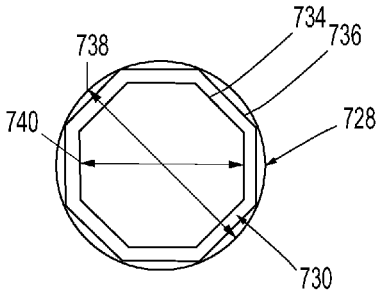
FIG. 7D is a cross-sectional view taken along section lines 7D-7D of FIG. 7C.

FIG. 7D illustrates a cross-sectional view taken along lines 7D-7D in FIG. 7C. The keyed portion 730 and non-keyed portion 728 are shown. The keyed portion 730 includes an interior keying surface 734 and an exterior keying surface 736. Both keying surfaces 734,736 have a similar geometric configuration, such as an octagonal keying shape. It is understood that any geometric configuration can be used such as a triangular, polygonal, hexagonal, pentagonal, truncated circle, square, elliptical, or D-shaped cross-sectional shapes without departing from the scope of the disclosure. The geometric shape of the keyed portion 730 can be formed on a metallic shaft by crimping or any other known mechanical process for deforming metal such as stamping, drawing, or forming, for example.

In one embodiment, the inner diameter 740 of the keyed section (perpendicular to a flat portion) is between about 10.16 mm (0.40") to about 15.24 mm (0.60"), or preferably about 12.7 mm (0.5"), and the shaft outer diameter of the non-keyed region is between about 12.7 mm (0.5") to about 15.24 mm (0.60"), or preferably between about 13.46 mm (0.530") to about 15 mm (0.59").

Figure 8:
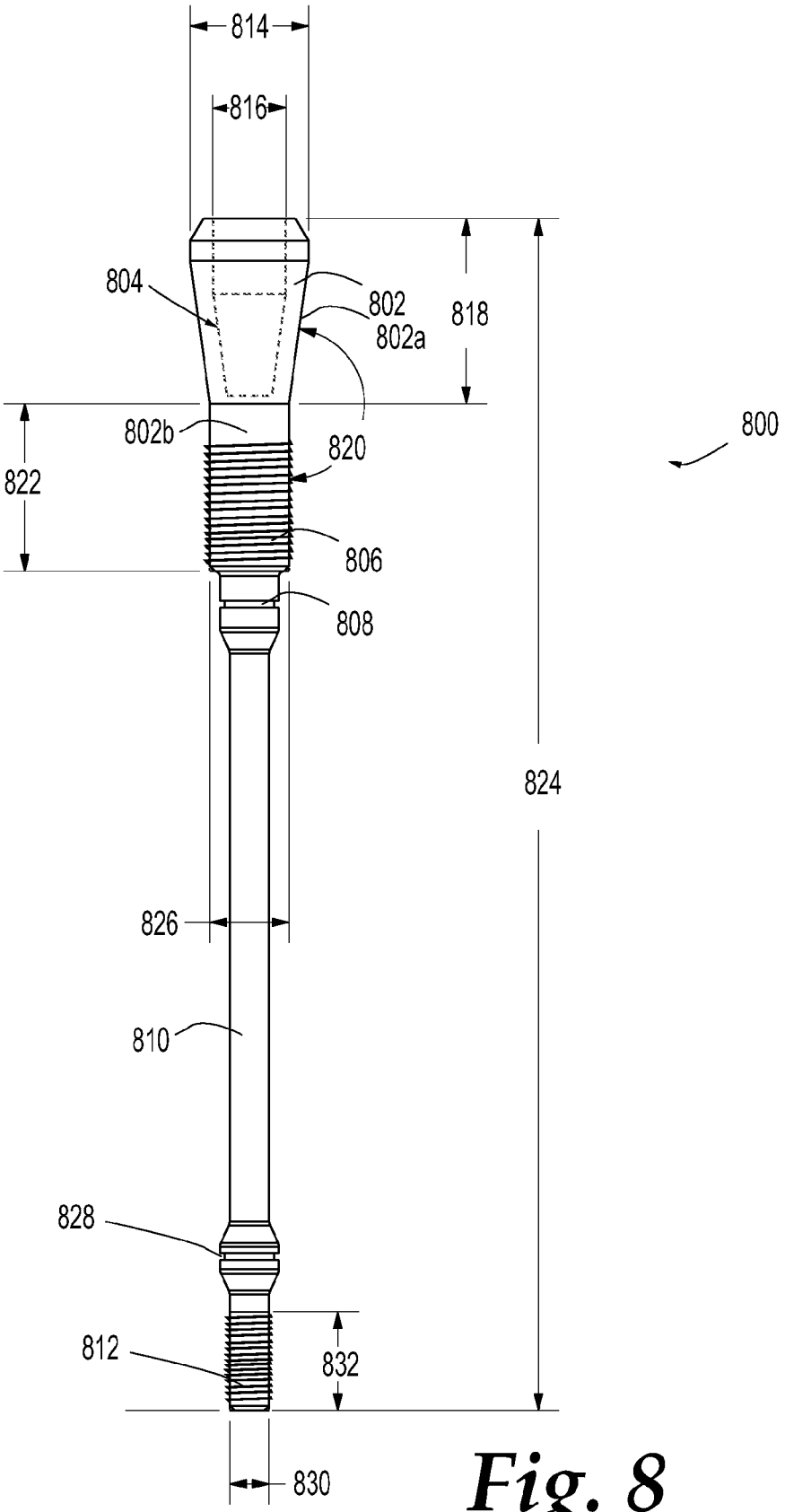
FIG. 8 is a side view of a rotational shaft and locking insert.

FIG. 8 illustrates an exemplary rotation piece 800 including a rotational shaft 810 and locking insert 802 that are formed of a similar material and are part of a single manufactured object. It is understood that the locking insert 802 and rotational shaft 810 could be formed separately. A first threaded portion 806 is also shown for engagement with the locking collar as previously described and a second threaded portion 812 is also shown. The second threaded portion 812 threadingly engages with a threaded bore located within the engaging mechanism that is rotated by the user. Preferably, once threaded, the second threaded portion 812 creates a permanent and immovable engagement between engaging mechanism and the rotational shaft 810 (i.e. the two parts cannot rotate with respect to one another). A first clip groove 828 and second clip groove 808 are located between the first threaded portion 806 and the second threaded portion 812.

In one embodiment, the first threaded portion 806 is an m8×1.25 left handed external thread extending a distance 822 of about 17 mm or between about 5 mm and 25 mm. The second threaded portion 812 can be an m4×0.7 external thread having a thread length 832 of between about 5 mm and about 15 mm or being about 10 mm. The rotational shaft diameter 830 can be between about 3 mm and about 8 mm to withstand the torsional forces required to engage the locking collar. In addition, the diameter 826 of the locking element (unflared portion) is about 6 mm to about 12 mm.

The flared surface 802*a* of the locking element 802 creates an angle 820 with the unflared portion 802*b* of between about 100° and about 180°. Furthermore, a cavity 804 (shown in dotted lines) is located within the locking insert 802. The cavity 804 acts to reduce the overall weight of the adjustable club assembly to provide the user with a shaft that feels similar in weight and feel to a non-adjustable shaft. However, the rigidity of the locking insert 802 is not impacted by the presence of the cavity 804.

In one embodiment, the cavity 804 has a maximum diameter 816 of between about 3 mm and about 11 mm. The maximum diameter 814 of the flared portion 802*a* is between about 12 mm and about 20 mm depending on the interior diameter of the lower shaft. The flared portion 802*a* extends along an axial axis a distance 818 of between about 15 mm and about 25 mm. In one embodiment, the flared portion 802*a* extends in the axial direction by a distance 818 of more than 50% of the total length of the locking insert 802.

In one embodiment, the total length 824 of the rotation piece 800 is between about 76.2 mm (3") and about 254 mm (10"). In one embodiment, a total length 824 of between about 101.6 mm (4") and 152.6 mm (6") is possible.

Figure 9A:
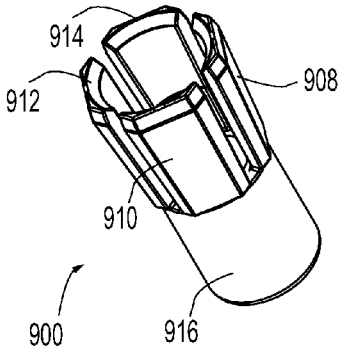
FIG. 9A is an isometric view of a locking collar.

FIG. 9A illustrates a locking collar 900 having a keyed outer surface of an octagonal shape to mate with the keying shape of the interior lower shaft surface 734. The locking collar 900 includes a base portion 916, and four finger portions 908,910,912,914. Each finger portion includes a faceted outer surface.

Figure 9B:
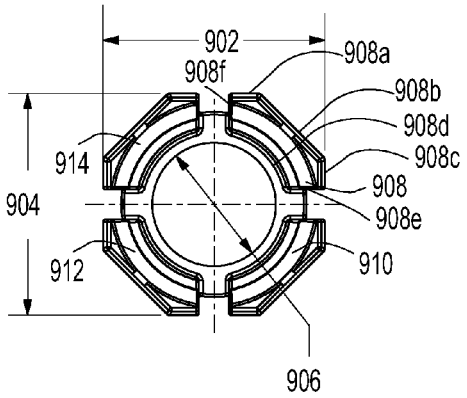
FIG. 9B is a top view of the locking collar in FIG. 9A.

FIG. 9B illustrates a top view of the locking collar 900. For the purposes of illustration, one finger 908 is described in more detail, although it is understood that all the finger portions 908,910,912,914 have similar features. Finger portion 908 includes a first outer surface, 908*a*, a second outer surface 908*b*, and a third outer surface 908*c*. The second outer surface 908*b* is located in-between the first outer surface 908*a* and third outer surface 908*c* along the circumference of the locking collar 900. Two side walls 908*e*, 908*f* connect the third outer surface 908*c* and first outer surface 908*a* to an interior curved wall 908*d* of the finger portion 908. The interior curved wall 908*d* of each finger portion engages with the sloped portion of the locking insert as previously described which causes the finger portions 908,910,912,914 to expand outwardly and cause a wedging forced on the interior surface of the lower shaft.

Each finger portion 908,910,912,914 includes three engagement surfaces that are correspondingly associated with three different keying walls within the interior surface of the lower shaft. It is understood that each finger portion 908, 910,912,914 can have two or more engagement surfaces such as between about two and about eight outer surfaces per finger portion 908,910,912,914 depending on the configuration of the interior wall of the lower shaft.

Because the locking collar 900 is axi-symmetrical about a longitudinal axis, the overall width 902 and height 904 of the locking collar 900 are equal to one another in the un-expanded position. In one embodiment, the overall height 904 and width 902 are between about 6.35 mm (0.25") and about 19.05 mm (0.75"). In one embodiment, the overall locking collar 900 height 904 and width 902 are about 12.2 mm (0.48") for engagement with a keyed inner shaft diameter of about 12.7 mm (0.5"). In other words, the overall height 904 and width 902 can have a gap distance of about 0.5 mm (0.02") or 1 mm (0.04") less than the inner shaft diameter of the lower shaft keying region.

Figure 9C:
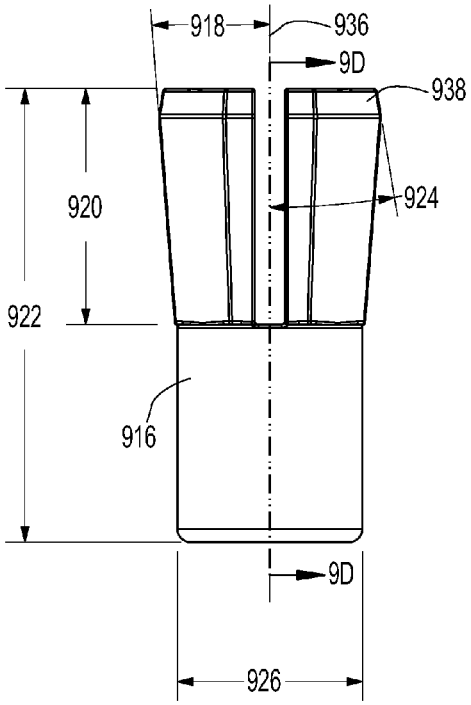
FIG. 9C is a side view of the locking collar in FIG. 9A.

FIG. 9C shows a side view of the locking collar. In the unexpanded position, each finger portion forms a slight angle 918 with the longitudinal axis 936 of between about two degrees and six degrees or between about four degrees and six degrees. At the tip of each finger portion is a flat engagement surface 938 that engages the interior wall of the lower shaft when the fingers are fully expanded for locking. The flat engagement surface 938 increases the engagement surface area and therefore the amount of locking friction between the locking collar 900 and the lower shaft interior wall. In one embodiment, the flat engagement surface 938 creates an angle 924 with the longitudinal axis 936 of between about seven and twelve degrees or between about eight and ten degrees. The finger portions 908,910,912,914 extend along the longitudinal axis 936 by a length 920 of between about 10 mm (0.4") and 20 mm (0.79") or by a length that is equal to or greater than half the length of the overall length 922 of the locking collar. Providing a sufficient longitudinal finger length 920 ensures that the fingers can engage into a locking position properly. The overall length 922 can be between about 20 mm (0.79") and about 30 mm (1.18") or greater than 30 mm (1.18"). The base 916 diameter 926 can be between about 8 mm (0.31") and about 12 mm (0.47").

Figure 9D:
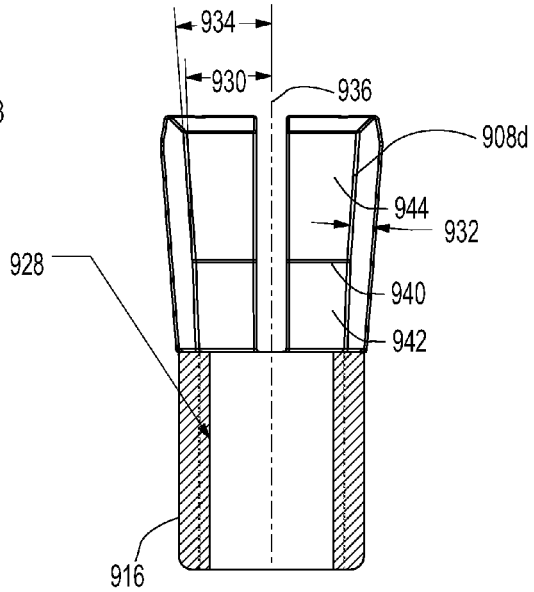
FIG. 9D is a cross-sectional view taken along section lines 9D-9D of FIG. 9C.

FIG. 9D illustrates a cross-sectional side view taken along cross section lines 9D-9D shown in FIG. 9C. The curved interior wall 908*d* of the finger portion 908 previously described also includes a first surface 942 having a first angle 930 with respect to the longitudinal axis 936 and a second surface 944 having a second angle 934 with respect to the longitudinal axis 936 (shown on a separate finger for clarity). The first 942 and second 944 surfaces are separated by a curved ridge 940. In one embodiment, the second angle 934 is greater than the first angle 930. In some embodiments, the second angle 934 is greater than the first angle 930 by between about one degree and three degrees, or preferably about two degrees. In one embodiment, the first angle can be about two degrees and the second angle is about four degrees. The first and second surfaces 942,944 are angled differently in order to ensure the locking collar 900 can be easily disengaged and re-engaged from the locking insert. If the two angled surfaces 942,944 were not present, it may require the user to input more rotations to successfully engage and disengage the locking collar from a locked to unlocked position.

In one embodiment, the wall thickness 932 of the finger portion is between about 0.5 mm (0.02") and about 2.0 mm (0.08"). In addition, the base portion 916 includes a threaded portion 928 for engagement with the locking insert threaded portion. In one embodiment, the threaded portion 928 is a m8×1.25 left handed internal thread that is tapped the full depth.

One advantage of the embodiments of the present invention is that a relatively low number of turns are required by the user (such as two to seven full rotations) to lock and unlock the locking mechanisms described above. In certain embodiments, less than one full rotation is required to lock or unlock the upper and lower shafts. Thus, a user can easily and quickly adjust the length of the shaft without a large amount of effort.

Another advantage of the embodiments of the present invention is that a reliable and effective arrangement is provided to efficiently lock and unlock an upper and lower shaft. In embodiments where the upper shaft is a composite material, a lightweight adjustable grip portion is described herein. In addition, the components described herein are produced and assembled to be free of rattle and noise that might be undesirable to a user.

Furthermore, another advantage of the embodiments of the present invention is that an adjustable putter is provided that aesthetically looks normal to a user on the exterior. The adjustable putter can also be re-gripped with any type of replacement grip after the original grip is worn or no longer desired.

Any of the embodiments described herein can be configured to have any total shaft length. For example, a total shaft length of the embodiments described herein can be about 838.2 mm (33"), 863.6 mm (34"), 889 mm (35"), 1041.4 mm (41"), 1092.2 mm (43"), 1219.2 mm (48"), or 1295.4 mm (51"). In one embodiment, the length of the shaft can be a length in the range of about 32" to 36". The embodiments described herein can have a shaft length associated with a belly putter having a total shaft length in the range of about 41" to 46". In further embodiments, the shaft can have a length associated with a mid-length putter or long "chin" putter having a total shaft length in the range of about 48" to 52". The total range of total club lengths is between about 812.8 mm (32") and about 1524 mm (60") as defined by the length of the shaft axis extended to a point that intersects with the ground plane when the golf club is held in the address position. Various putter grip shapes can be provided such as a pistol grip or other shape conforming with the United States Golf Association (USGA) rules of golf.

Materials

The components of the above described components disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyoxymethylene, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®). Furthermore, any of the above components can be made of nylon or glass filled nylon material and an injection molding process can be utilized in the production of any of the components mentioned herein.

In view of the many possible embodiments to which the principles of the disclosed invention may be applied, it should be recognized that the illustrated embodiments are only preferred examples of the invention and should not be taken as limiting the scope of the invention. For example, although a putter shaft is specifically described above, it is understood that the present invention can be applied to other golf club shafts including drivers or irons. It will be evident that various modifications may be made thereto without departing from the broader spirit and scope of the invention as set forth. The specification and drawings are, accordingly, to be regarded in an illustrative sense rather than a restrictive sense.

We claim:

1. A golf club comprising:

a grip portion including a grip cover and grip shaft;

a lower shaft connected with the grip portion;

a club head connected with a lower portion of the lower shaft;

a first axial direction being co-axial with the lower shaft and extending toward the club head;

a second axial direction opposite the first axial direction;

an engaging mechanism located within the grip portion and connected with a top collar;

a rotational shaft connected with the engaging mechanism and being configured to rotate upon movement by the engaging mechanism;

a locking mechanism connected with the rotational shaft, the locking mechanism including a locking insert and a locking collar located on the locking insert, the locking insert being configured to retain the locking collar during axial movement; and the lower shaft having an inner surface that is in frictional contact with the locking collar, wherein the locking insert is movably engaged with the locking collar and a rotational movement by the rotational shaft in a first rotational direction causes the locking collar to move in the second axial direction to create a frictional locking engagement between the locking collar and the inner surface of the lower shaft, wherein the locking collar has at least two finger portions that engage an engaging surface of the locking insert to prevent movement with respect to the lower shaft.

2. The golf club of claim 1, wherein a rotational movement by the rotational shaft in a second rotational direction releases the locking engagement between the locking collar and the inner surface of the lower shaft.

3. The adjustable length golf club of claim 1, wherein the locking collar includes a keying outer surface for engagement with the interior surface of the lower shaft to prevent the locking collar from rotating.

4. The adjustable length golf club of claim 1, wherein the at least two finger portion includes three or four expandable finger portions.

5. The adjustable length golf club of claim 1, wherein a maximum amount of axial shaft adjustment is defined by a keying portion located on the lower shaft.

6. The adjustable length golf club of claim 5, wherein a grip shaft keying portion has a length that is greater than or equal to a length of the lower shaft keying portion.

7. The adjustable length golf club of claim 5, wherein the keying portion located on the lower shaft extends a distance of between about 25.4 mm and about 381 mm.

8. The adjustable length golf club of claim 1, wherein a weight zone extending from the upper end of the grip portion to a lower end of the grip portion weighs between about 100 g and about 135 g.

9. The adjustable length golf club of claim 1, wherein a keying portion of the locking collar engages with a keyed inner surface of the lower shaft thereby preventing the locking collar from substantially rotating.

10. The adjustable length golf club of claim 1, wherein a maximum amount of axial shaft adjustment is between about 25.4 mm and about 127 mm.

11. The adjustable length golf club of claim 1, wherein a total club length including the lower shaft, club head, and grip portion is between about 812.8 mm and about 1524 mm.

12. The adjustable length golf club of claim 1, wherein the locking collar includes a first polygonal keying shape.

13. The adjustable length golf club of claim 12, wherein the first polygonal keying shape of the locking collar is located on a finger portion of the locking collar and is configured to engage with a matching second polygonal keying shape located on an interior surface of the lower shaft.

14. The adjustable length golf club of claim 13, wherein the engagement mechanism is located within about 25.4 mm of the butt end of the grip portion.

15. A golf club comprising:

a grip portion including a grip cover and grip shaft;

a lower shaft connected with the grip portion;

a club head connected with a lower portion of the lower shaft;

a first axial direction being co-axial with the lower shaft and extending toward the club head;

a second axial direction opposite the first axial direction;

an engaging mechanism located within the grip portion and connected with a top collar;

a rotational shaft connected with the engaging mechanism and being configured to rotate upon movement by the engaging mechanism;

a locking mechanism connected with the rotational shaft, the locking mechanism including a locking insert and a locking collar located on the locking insert, the locking insert being configured to retain the locking collar during axial movement; and the lower shaft having an inner surface that is in frictional contact with the locking collar, wherein the locking insert is movably engaged with the locking collar and a rotational movement by the rotational shaft in a first rotational direction causes the locking collar to move in the second axial direction to create a frictional locking engagement between the locking collar and the inner surface of the lower shaft, wherein a maximum amount of axial shaft adjustment is defined by a keying portion located on the lower shaft.

16. A golf club comprising:

a grip portion including a grip cover and grip shaft;

a lower shaft connected with the grip portion;

a club head connected with a lower portion of the lower shaft;

a first axial direction being co-axial with the lower shaft and extending toward the club head;

a second axial direction opposite the first axial direction;

an engaging mechanism located within the grip portion and connected with a top collar;

a rotational shaft connected with the engaging mechanism and being configured to rotate upon movement by the engaging mechanism;

a locking mechanism connected with the rotational shaft, the locking mechanism including a locking insert and a locking collar located on the locking insert, the locking insert being configured to retain the locking collar during axial movement; and the lower shaft having an inner surface that is in frictional contact with the locking collar, wherein the locking insert is movably engaged with the locking collar and a rotational movement by the rotational shaft in a first rotational direction causes the locking collar to move in the second axial direction to create a frictional locking engagement between the locking collar and the inner surface of the lower shaft, wherein a maximum amount of axial shaft adjustment is defined by a keying portion located on the lower shaft, wherein a grip keying portion has a length that is greater than or equal to a length of the lower shaft keying portion.

* * * * *